US012006016B2

(12) United States Patent
Maksimainen et al.

(10) Patent No.: US 12,006,016 B2
(45) Date of Patent: Jun. 11, 2024

(54) MARINE PROPULSION UNIT

(71) Applicant: ABB Oy, Helsinki (FI)

(72) Inventors: Aki Maksimainen, Helsinki (FI); Veli-Pekka Peljo, Helsinki (FI); Petri Pellinen, Helsinki (FI)

(73) Assignee: ABB Oy, Helsinki (FI)

( * ) Notice: Subject to any disclaimer, the term of this patent is extended or adjusted under 35 U.S.C. 154(b) by 361 days.

(21) Appl. No.: 17/413,034

(22) PCT Filed: Dec. 16, 2019

(86) PCT No.: PCT/FI2019/050895
§ 371 (c)(1),
(2) Date: Jun. 11, 2021

(87) PCT Pub. No.: WO2020/120844
PCT Pub. Date: Jun. 18, 2020

(65) Prior Publication Data

US 2022/0009608 A1 Jan. 13, 2022

(30) Foreign Application Priority Data

Dec. 14, 2018 (WO) ..... PCT/FI2018/050921

(51) Int. Cl.
*B63H 5/03* (2006.01)
*B63H 21/17* (2006.01)
(Continued)

(52) U.S. Cl.
CPC ..... *B63H 5/03* (2013.01); *B63H 21/17* (2013.01); *B63H 2005/025* (2013.01); *B63H 2023/005* (2013.01)

(58) Field of Classification Search
CPC . B63H 5/00; B63H 5/03; B63H 21/00; B63H 21/17; B63H 2005/025; B63H 2023/005
(Continued)

(56) References Cited

U.S. PATENT DOCUMENTS 1,823,169 A 9/1931 Ernst et al.
2,230,708 A 2/1941 Albert
(Continued)

FOREIGN PATENT DOCUMENTS

EP 2944556 B1 7/2018
SU 510407 A1 4/1976

OTHER PUBLICATIONS

International Search Report and Written Opinion of the International Searching Authority; PCT/FI2019/050895; Completed: Feb. 12, 2020; dated Feb. 19, 2020; 9 Pages.

*Primary Examiner* — Lars A Olson
(74) *Attorney, Agent, or Firm* — Whitmyer IP Group LLC

(57) ABSTRACT

A marine propulsion unit including a rotary casing rotatable about a central axis A, and blades extending axially from the rotary casing for rotation with the rotary casing about the central axis A, wherein each blade is mounted for pivotal movement about blade axes B. A blade shaft portion of each blade is at least partly surrounded by a blade housing and by a blade portion of each blade is outside the blade housing, wherein the blade housing is releasable attached to the rotary casing, and each blade being supported in the blade housing by means of bearings for the pivotal movement.

33 Claims, 21 Drawing Sheets

(51) Int. Cl.
*B63H 5/02* (2006.01)
*B63H 23/00* (2006.01)

(58) Field of Classification Search
USPC ..... 440/38
See application file for complete search history.

(56) References Cited

U.S. PATENT DOCUMENTS

| | | | | | |
|---|---|---|---|---|---|
| 2,916,093 | A | | 12/1959 | Hendrickson et al. | |
| 3,134,443 | A | * | 5/1964 | Snow | B63H 1/10 440/93 |
| 5,462,406 | A | * | 10/1995 | Ridgewell | B63H 1/10 416/111 |
| 5,588,798 | A | * | 12/1996 | Fork | B63H 1/10 416/174 |
| 5,632,661 | A | * | 5/1997 | Jurgens | B63H 1/10 440/93 |
| 6,244,919 | B1 | * | 6/2001 | Valentini | B63H 1/10 440/93 |

* cited by examiner

MARINE PROPULSION UNIT

TECHNICAL FIELD

The invention relates to a marine propulsion unit, and to a cylcloidal-marine propulsion systems such as to flappin foil propulsors for marine vessels or the like.

BACKGROUND

Publication EP 2 944 556 presents a cycloidal marine-propulsion system. One problem with such cycloidal marine-propulsion system is that due to the relatively complex construction, mounting of a cycloidal marine-propulsion system to a ship and servicing of a cycloidal marine-propulsion system that is mounted to a ship is not easy.

SUMMARY

The object of the invention is to provide a marine propulsion unit that is easy to mount to a ship and that is easier to service.

The marine propulsion of the invention is characterized by the definitions of independent claim 1.

Preferred embodiments of the marine propulsion are defined in the dependent claims 2 to 31.

Claim 32 relates to a combination of a marine vessel and a marine propulsion unit according to any of the claims 1 to 31.

BRIEF DESCRIPTION OF THE DRAWINGS

In the following the invention will described in more detail by referring to the figures, which.

DETAILED DESCRIPTION

The figures show an embodiment of the marine propulsion unit.

The marine propulsion unit comprises a rotary casing 1 rotatable about a central axis A.

Figure 1:
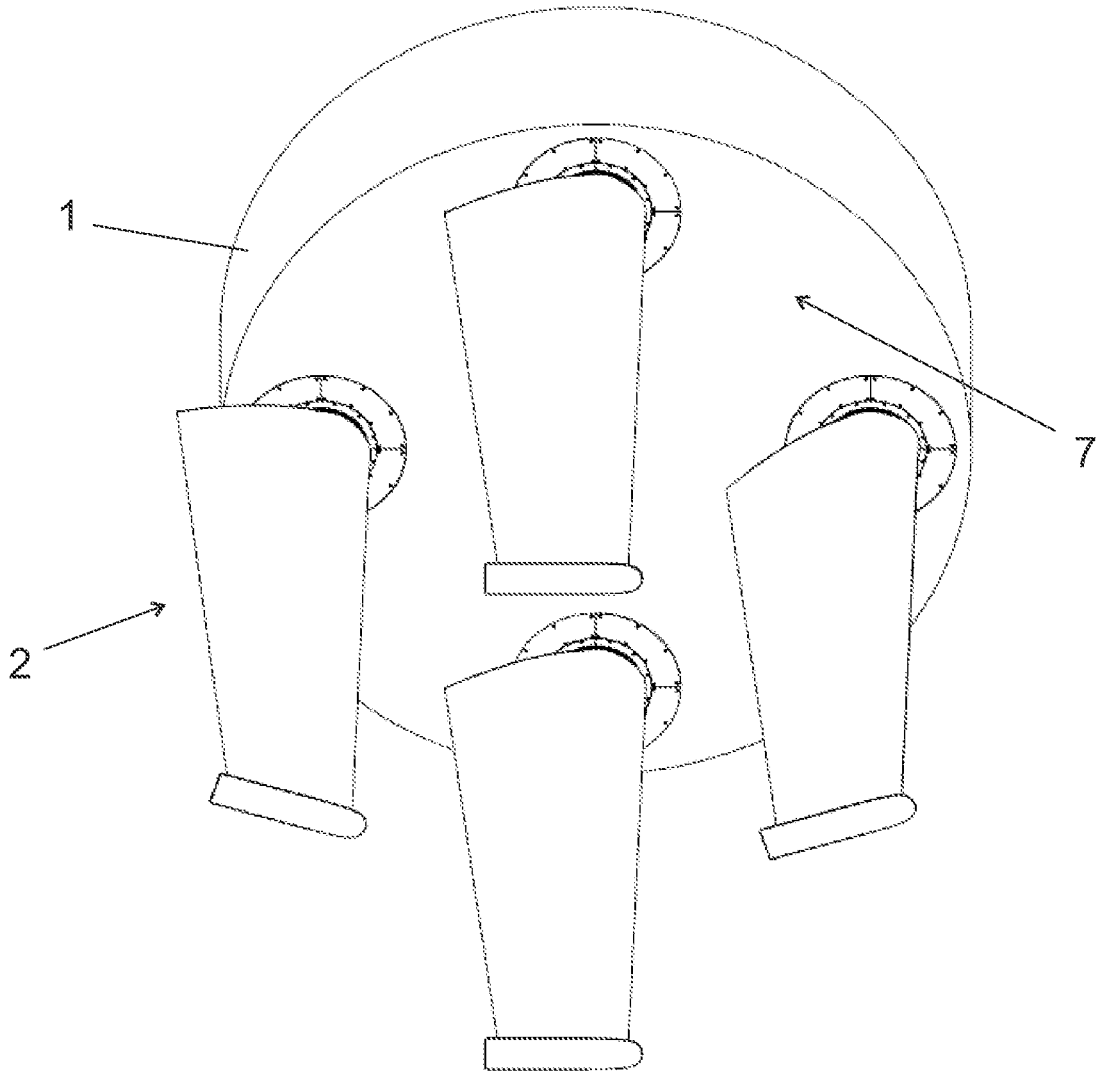
FIG. 1 shows a first embodiment of the marine propulsion unit.
Figure 2:
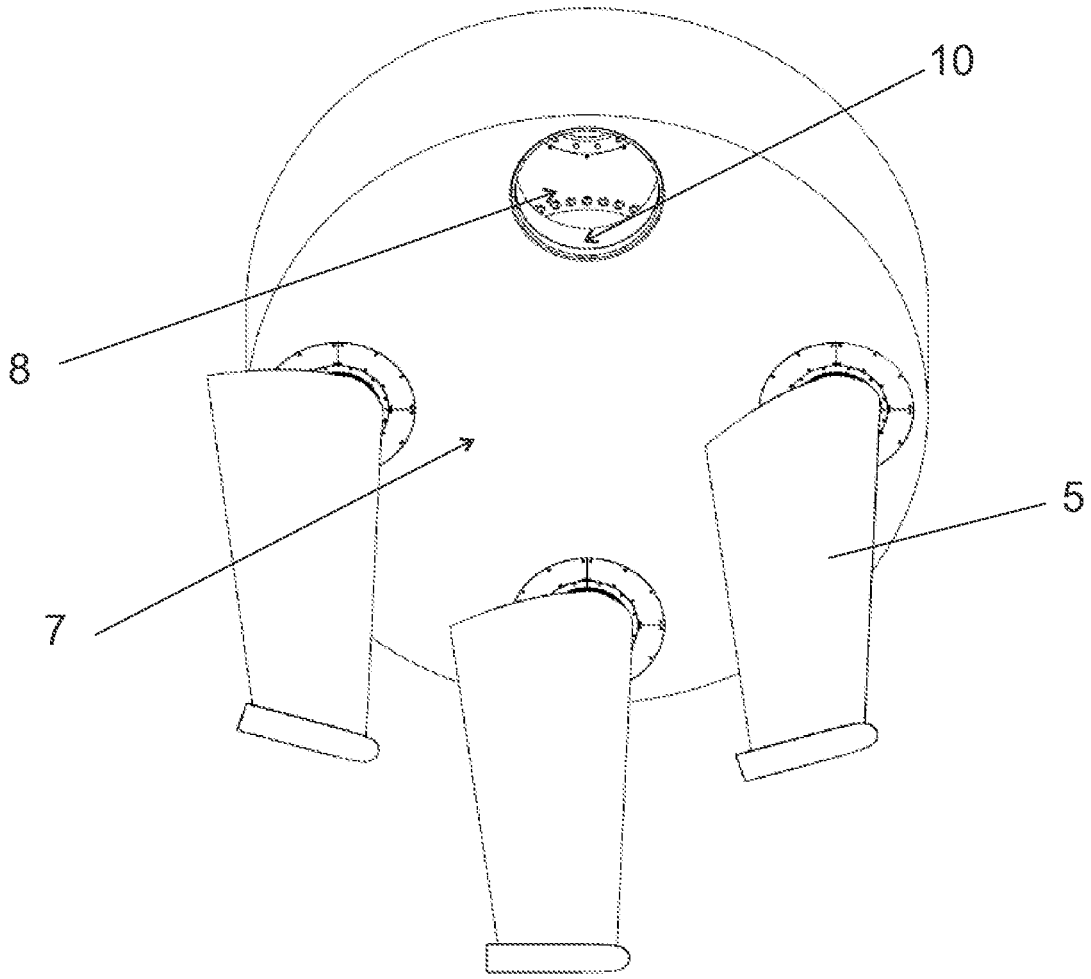
FIG. 2 shows the marine propulsion unit shown in FIG. 1 in a state, where one blade unit is removed.
Figure 3:
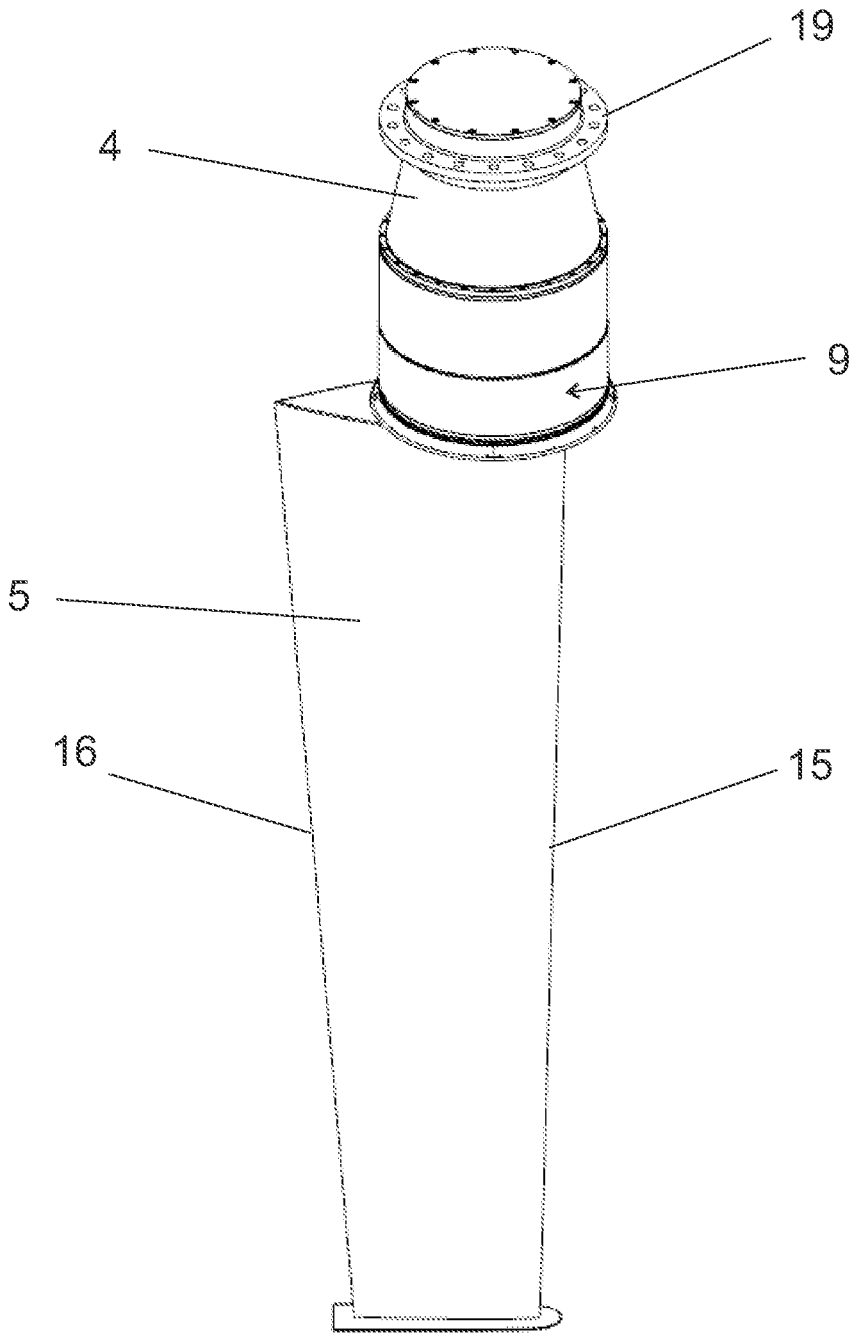
FIG. 3 shows a blade unit of the marine propulsion unit shown in FIG. 1.
Figure 4:
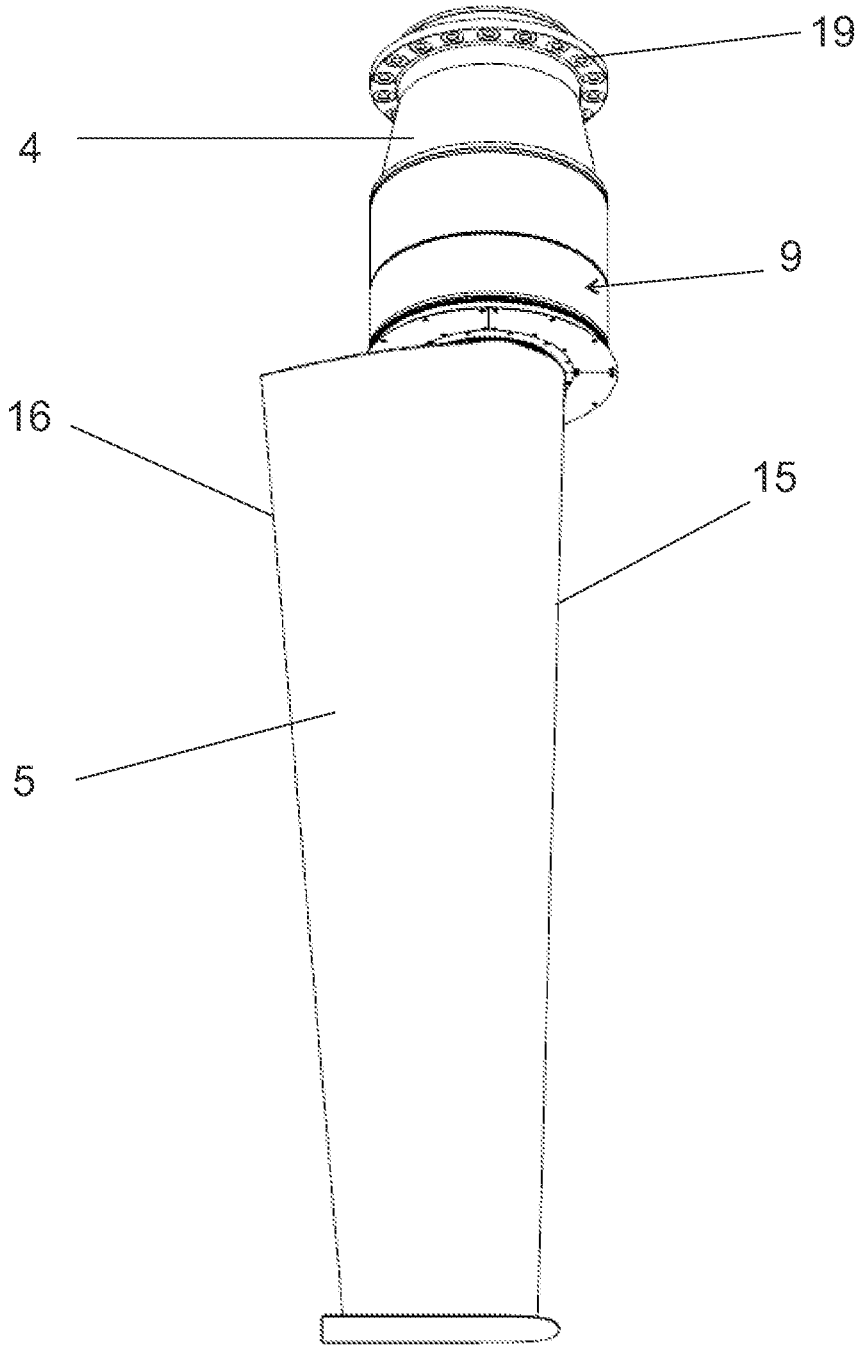
FIG. 4 shows the blade unit shown in FIG. 3 from another angle.
Figure 5:
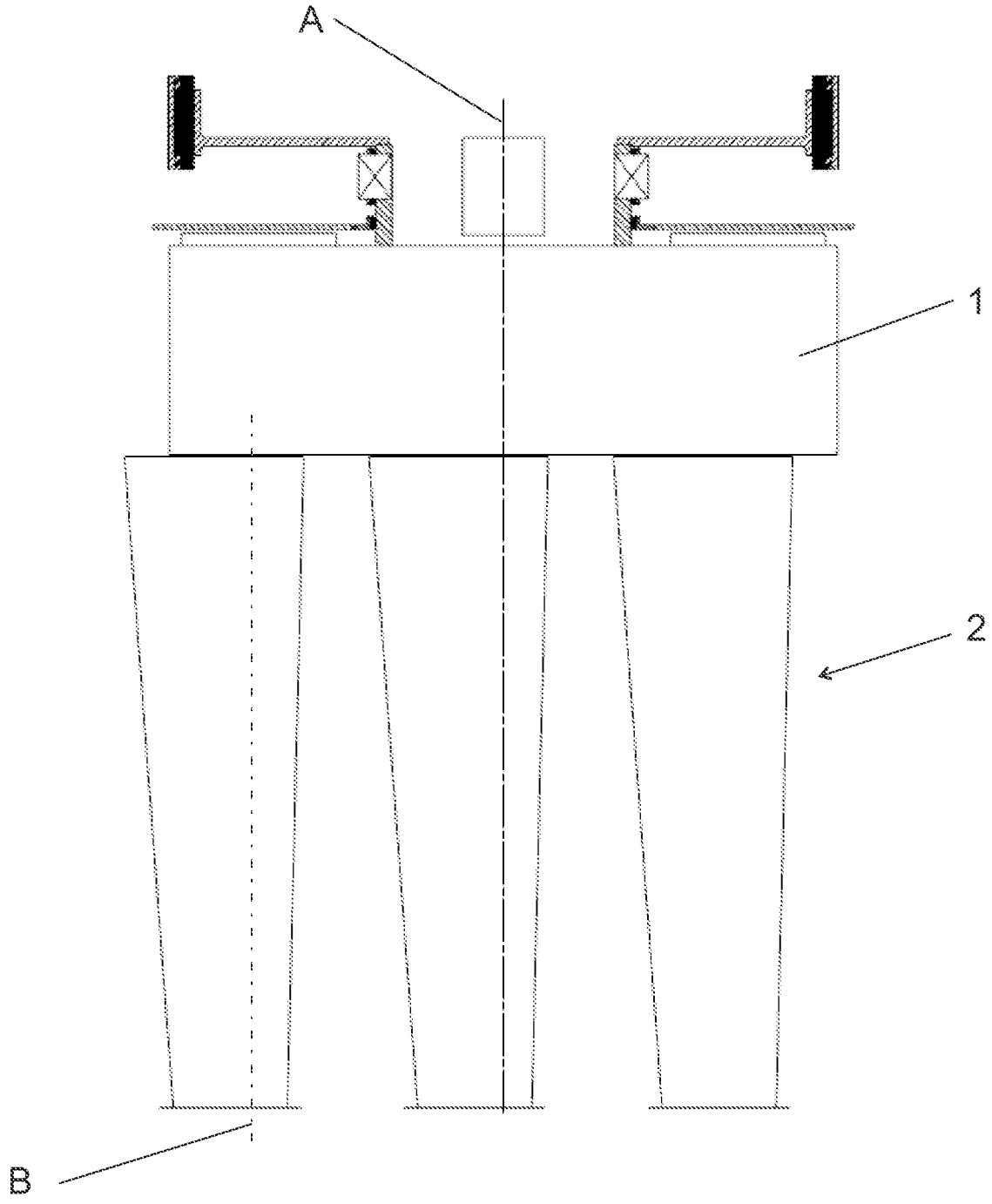
FIG. 5 shows the marine propulsion unit shown in FIG. 1 in partly cut view.

The marine propulsion unit comprises blades 2 extending axially from the rotary casing 1 for rotation with the rotary casing 1 about the central axis A. Each blade 2 is preferably, but not necessarily, mounted for pivotal movement about blade axes B generally parallel to the central axis A as illustrated in FIG. 5.

A blade shaft portion 3 of each blade 2 is at least partly surrounded by a blade housing 4 and a blade portion 5 of each blade 2 is outside the blade housing 4.

The blade housing 4 is releasable attached to the rotary casing 1.

Each blade 2 is supported in the blade housing 4 by means of bearings 6*a* and 6*b* for said pivotal movement i.e. to make possible said pivotal movement.

In the marine propulsion unit, each blade 2 can together with a respective blade housing 4 be considered to form a blade unit (not marked with a reference numeral).

The marine propulsion unit provides for several advantages. The blade 2 that is supported in the blade housing 4 by means of the bearings 6*a* and 6*b* provides for a clear spare part package. The blade 2 that is supported in the blade housing 4 by means of the bearings 6*a* and 6*b* provides for a pre-assembled module that can be tested and be approved for example by classification societies prior mounting the blade 2 to the rotary casing 1 of the marine propulsion unit. Mounting of the blades 2 to the rotary casing 1 is easy: Because the blade shaft portion 3 of the blade 2 is already fitted into the bearings 6*a* and 6*b* for example at a factory, the blade shaft portion 3 of the blade 2 need not to be fitted into the bearings 6*a* and 6*b* simultaneously when mounting the blade 2 to the rotary casing 1 for example at a shipyard. This also makes servicing and replacing of individual blades easy. This is an advantage, because the blades 2 can be 2 to 3 meters long. The risk that the bearings 6*a* and 6*b* are damaged is consequently reduced.

The marine propulsion unit comprises preferably, but not necessarily, a retaining arrangement (not shown in the figures) for keeping the blade shaft portion 5 of each blade 2 in a respective blade housing. Said retaining arrangement can for example comprise at least one of a wedge connection, a shrink connection, a retaining screw and a retaining ring.

The blades 2 are preferably, but not necessarily, evenly distributed at the rotary casing 1 with respect to the central axis A.

The rotary casing 1 of the marine propulsion unit comprises preferably, but not necessarily, a lower surface 7 that is configured to be at least partly in direct contact with water. The lower surface 7 can be flat as shown in the figures.

If the rotary casing 1 comprises such lower surface 7, the rotary casing 1 comprises preferably, but not necessarily, mounting seats 8 configured to releasable receive the blade housing 4 of each blade 2 such that the mounting seats 8 extend from the lower surface 7 of the rotary casing 1 into the rotary casing 1 and form apertures in the rotary casing 1. Alternatively, at least one mounting seat 8 can extend from the lower surface 7 of the rotary casing 1 into the rotary casing 1 so that said at least one mounting seat 8 form a recess in the rotary casing 1.

Figure 6:
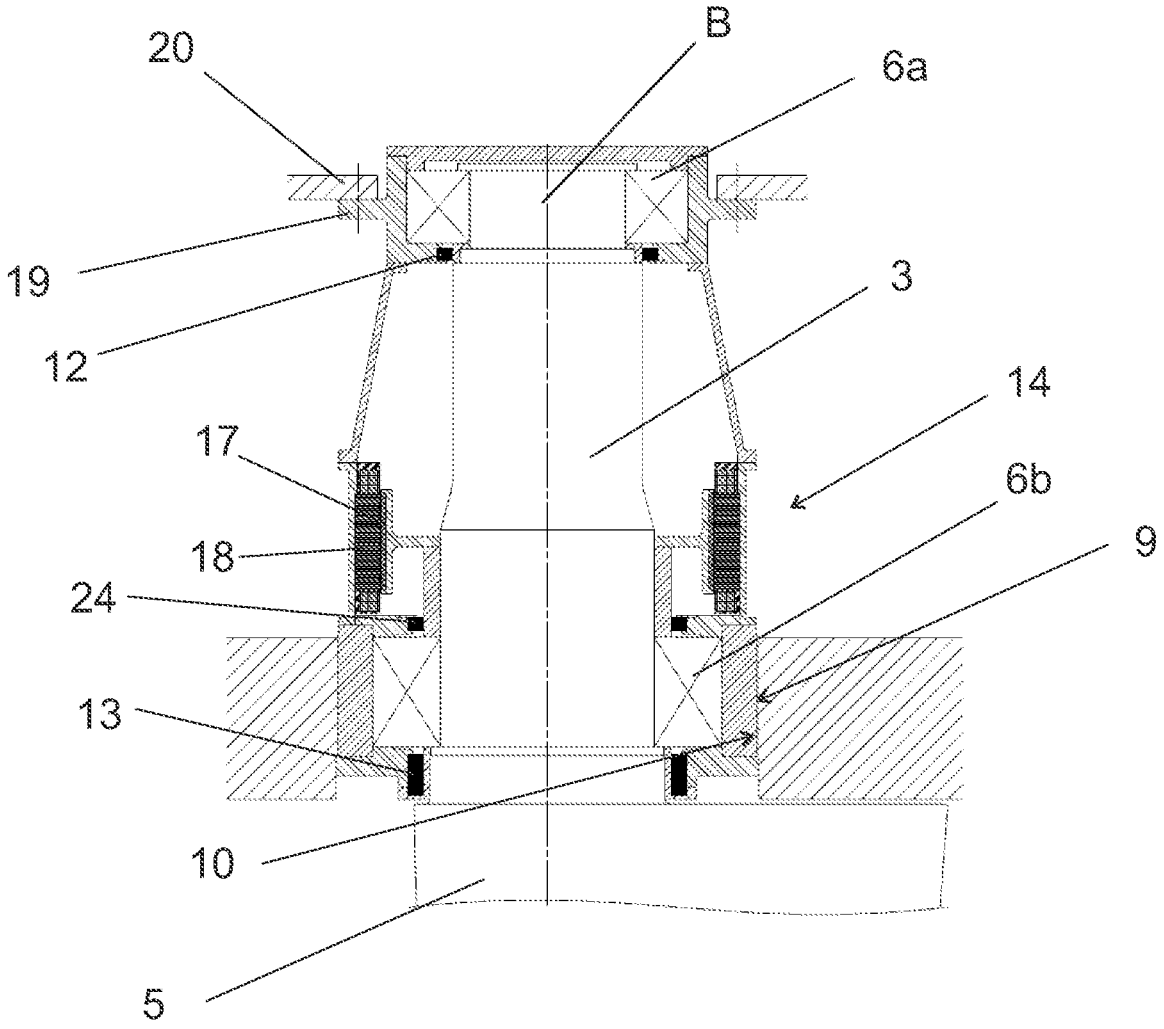
FIG. 6 shows a detail of the blade unit shown in FIG. 3 in cut view.

If the rotary casing 1 comprises such mounting seats, the blade housing 4 has preferably, but not necessarily, an outer surface 9, which can be a circumferential outer surface, as in FIG. 6, and the mounting seat 8 has preferably, but not necessarily, an inner surface 10, which can be a circumferential inner surface, as in FIG. 6, such that the outer surface 9 of the blade housing 4 at least partly abuts the inner surface 10 of the mounting seat 8 so as to prevent lateral movement of the blade housing 4 in the mounting seat 8. The inner surface 10 together with the outer surface 9 also functions as steering surfaces when mounting the blade housing 4 together with the blade 2 at the rotary casing 1.

If the rotary casing 1 comprises such mounting seats 8, the blade housing 4 has preferably, but not necessarily, a first section (not marked with a reference numeral) where the cross-section form and the outer dimensions of the blade housing 4 corresponds to the cross-section form and inner dimensions of a second section (not marked with a reference numeral) of the mounting seat 8 so as to prevent lateral movement of the blade housing 4 in the mounting seat 8. The first section together with the second section also functions as steering surfaces when mounting the blade housing 4 together with the blade 2 at the rotary casing 1.

Such first section of the blade housing 4 is preferably, but not necessarily, formed by a circumferential outer surface of the blade housing 4 that has an outer diameter that essentially corresponds to the inner diameter of a second section of the mounting seat 8 in the form of a circumferential inner surface of the mounting seat 8 extending from a lower surface 7 of the rotary casing 1 so as to prevent lateral movement of the blade housing 4 in the mounting seat 8.

If the rotary casing 1 comprises such mounting seats 8, the blade housing 4 can comprise a first lower flange 25 having an upper surrounding surface 26 configured to abut a lower surrounding surface 27 of a second lower flange 28 that surrounds the mounting seat 8 when the blade housing 4 is brought into a mounting position in the mounting seat 8 from the side of the lower surface 7 of the rotary casing 1.

If the rotary casing 1 comprises such mounting seats 8, the mounting seats 8 are preferably, but not necessarily, designed and dimensioned to allow inserting and removal of a blade housing 4 having a blade 2 supported in the blade housing 4 by means of bearings 6*a* and 6*b* solely from the side of lower surface 7 of the rotary casing 1. In other words, the so-called pre-assembled module comprising a blade housing 4 having a blade 2 supported in the blade housing 4 by means of bearings 6*a* and 6*b* is preferably, but now necessarily, solely insertable and removable from a mounting sear extending from the lower surface of the rotary casing from the side of lower surface 7 of the rotary casing 1. This means that the so-called pre-assembled module can be inserted and removed from the rotary casing 1 without disconnecting the rotary casing for example from the hull 23 of a ship to which the rotary casing 1 is mounted.

Figure 19:
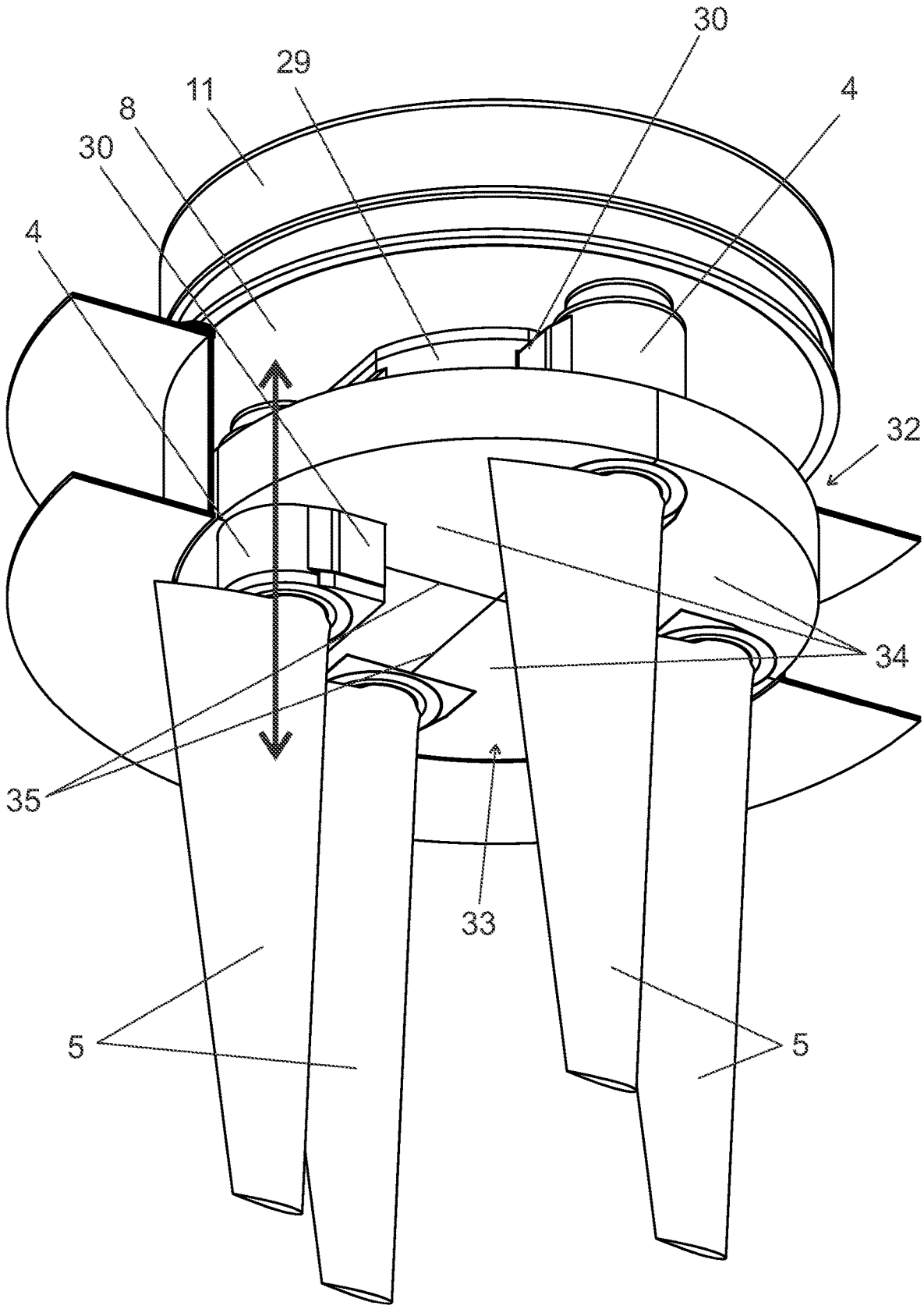
FIG. 19 shows in partly cut view a fourth embodiment of the marine propulsion unit in a state, where one blade unit is either being removed from a seat extending from the lower surface of the rotary casing by moving the blade housing of the blade unit out of said seat from the side of the lower surface or the rotary casing, or being mounted into seat extending from the lower surface of the rotary casing by moving the blade housing of the blade unit into said seat from the side of the lower surface or the rotary casing.

In the second embodiment of the marine propulsion unit shown in FIGS. 9 to 14, the third embodiment of the marine propulsion unit shown in FIGS. 15 to 18, and in the fourth embodiment of the marine propulsion unit shown in FIG. 19, the rotary casing 1 comprises a central portion 29, each blade housing 4 comprises a first lateral attachment member 30, and each blade housing 4 is releasable attached to the central portion 29 of the rotary casing 1 so that the first lateral attachment member 30 of each blade housing 4 is attached to corresponding second lateral attachment member 31 provided laterally at the central portion 29 of the rotary casing 1. The first lateral attachment members 30 can be planar as shown in the figures. The second lateral attachment members 31 can be planar as shown in the figures. A first lateral attachment member 30 of a blade housing 4 can for example be attached to a second lateral attachment member 31 provided laterally at the central portion 29 of the rotary casing 1 by using external fastening means (not illustrated in the figures) once the first lateral attachment member 30 of a blade housing 4 is brought into contact with a second lateral attachment member 31 provided laterally at the central portion 29 of the rotary casing 1. More precisely, as shown in FIGS. 10, 12, 17 and 18, this is done by moving such as lifting the blade housing 4 having a blade 2 supported in the blade housing 4 by means of bearings 6*a* and 6*b* in relation to the rotary casing 1 so that the first lateral attachment member 30 of a blade housing 4 is brought into contact with a second lateral attachment member 31 provided laterally at the central portion 29 of the rotary casing 1, whereafter external fastening means are used for releasable fasten the first lateral attachment member 30 of a blade housing 4 to the second lateral attachment member 31 provided laterally at the central portion 29 of the rotary casing 1.

In the third embodiment of the marine propulsion unit shown in FIGS. 15 to 18, and in the fourth embodiment of the marine propulsion unit shown in FIG. 19 the rotary casing 1 comprises an outer casing 32 surrounding the central portion 29 or the rotary casing 1, the outer casing comprises mounting seats 8 configured to releasable receive the blade housing 4 of each blade 2, and the mounting seats 8 extend from a lower outer surface 33 of the outer casing 32 of the rotary casing 1. One purpose of the outer casing is to improve the hydrodynamic characteristics of the marine propulsion unit by creating a smooth design with less edges, cavities and protrusions and the like.

In the third embodiment of the marine propulsion unit shown in FIGS. 15 to 18, and in the fourth embodiment of the marine propulsion unit shown in FIG. 19 the outer casing 32 of the rotary casing 1 is composed of several outer casing sections 34 separated by division planes 35 dividing each mounting seat 8 in the outer casing in at least two mounting seat sections (not marked with a reference numeral) so the each adjacent outer casing sections 34 of the outer casing 32 comprises a mounting seat section of at least one mounting seat 8.

In the in the third embodiment of the marine propulsion unit shown in FIGS. 15 to 18 the mounting seats 8 in the outer casing 32 of the rotary casing 1 is designed and dimensioned so that outer casing sections 34 must be removed to allow inserting and removal of a blade housing 4 having a blade 2 supported in the blade housing by means of bearings 6*a* and 6*b*. Because the outer casing 32 is divided by division planes 35 into several outer casing sections 34, only some outer casing sections 34 and not the complete outer casing 32 needs to be removed to allow inserting and removal of a blade housing 4 having a blade 2 supported in the blade housing by means of bearings 6*a* and 6*b*.

In the in the fourth embodiment of the marine propulsion unit shown in FIG. 19 the mounting seats 8 in the outer casing 32 of the rotary casing 1 is designed and dimensioned to allow inserting and removal of a blade housing 4 having a blade 2 supported in the blade housing by means of bearings 6*a* and 6*b* solely from the side of lower outer surface 35 of the outer casing 32 of the rotary casing 1 and without removing outer casing sections 34. In other words, in the fourth embodiment of the marine propulsion unit shown in FIG. 19, a blade housing 4 having a blade 2 supported in the blade housing by means of bearings 6*a* and 6*b* can moved such as lifted up into a mounting seat 8 extending from the lower surface 22 of the outer casing 32 and correspondingly be lowered from a mounting seat 8 extending from the lower surface 22 of the outer casing 32 without removing outer casing sections 34. In the in the fourth embodiment of the marine propulsion unit shown in FIG. 19 the mounting seats 8 extending from the lower surface 22 of the outer casing 32 are preferably, but not necessarily, designed to that the mounting seats 8 are configured to steer the first lateral attachment member 30 of a blade housing 4 into contact with a second lateral attachment member 31 provided laterally at the central portion 29 of the rotary casing 1 when blade housing 4 having a blade 2 supported in the blade housing by means of bearings 6*a* and 6*b* is moved into the mounting seat 8.

If the marine propulsion unit comprises first lateral attachment members 30 at the blade housings and second lateral attachment members 31 at a central portion 29 of the rotary casing 29, electrical power and/or steering signal connectors (not illustrated in the figures) can also be provided in connection with such first lateral attachment members 30 at the blade housings and second lateral attachment members 31 at a central portion 29 of the rotary casing 29 so that optional electrical power and/or steering signal connections between the blade housing 4 having a blade 2 supported in the blade housing by means of bearings 6*a* and 6*b* and other parts of the marine propulsion unit can easily be formed in connection with releasable fastening the first lateral attachment member 30 of a blade housing 4 to the second lateral attachment member 31 provided laterally at the central portion 29 of the rotary casing 1.

Figure 20:
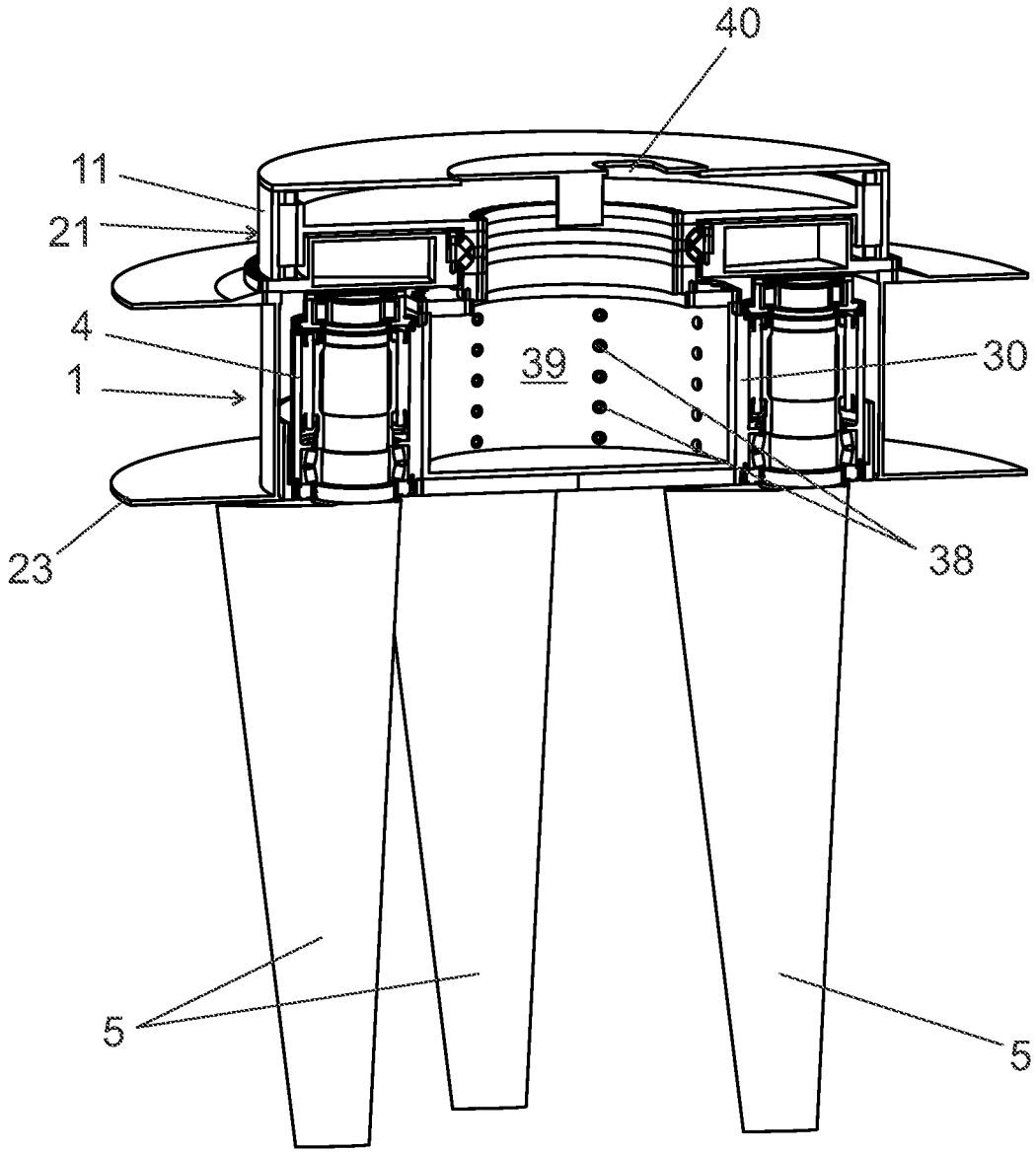
FIG. 20 shows in partly cut view the marine propulsion unit shown in FIG. 9.
Figure 21:
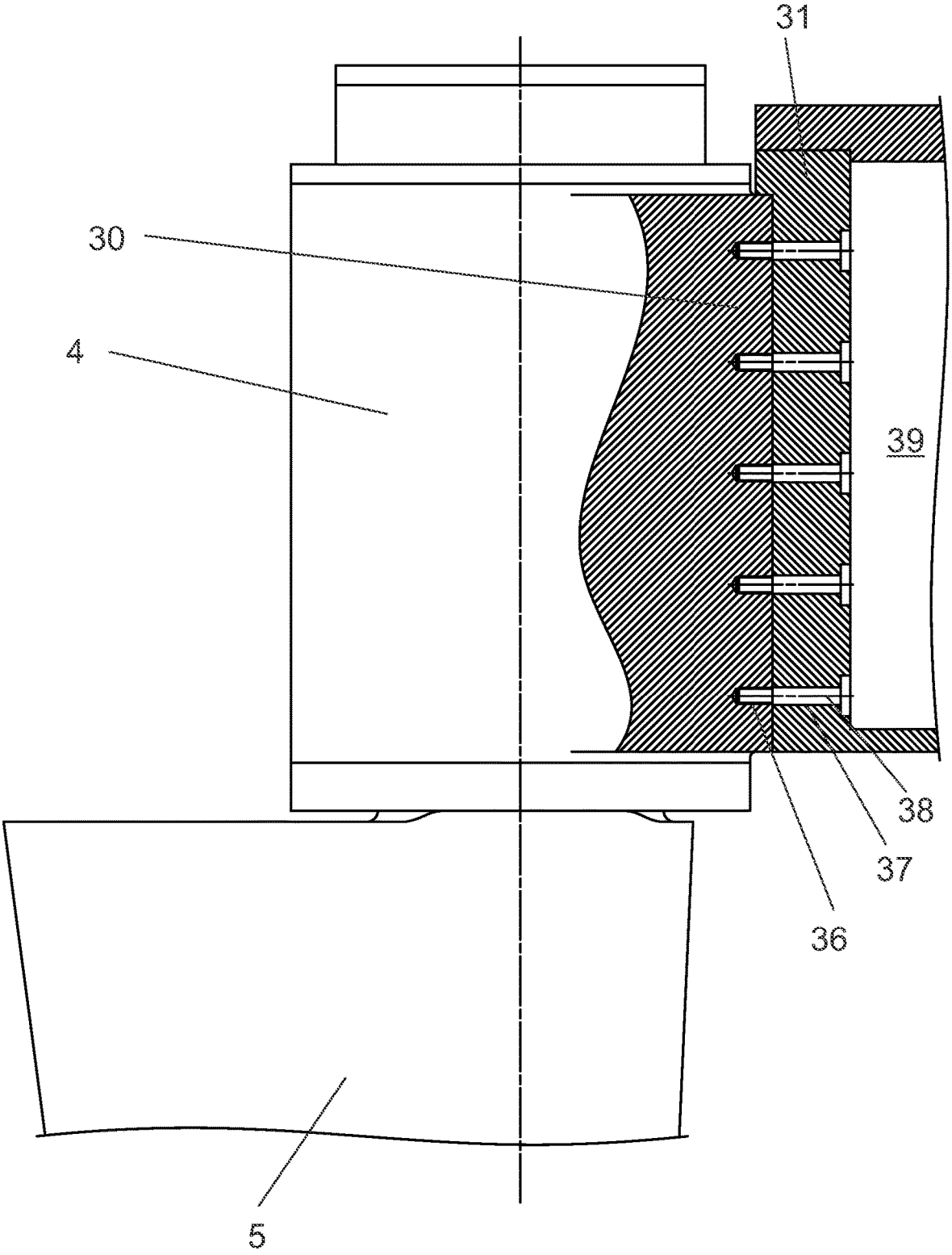
FIG. 21 shows in partly cut view and in greater detail an example of the fastening of the blade housing of a blade unit to the central portion of the rotary casing in the embodiments of the marine propulsion units illustrated in FIGS. 9 to 20.

If the marine propulsion unit comprises first lateral attachment members 30 at the blade housings and second lateral attachment members 31 at a central portion 29 of the rotary casing 29, the rotary casing 1 has preferably, but not necessarily, as illustrated in FIGS. 20 and 21, a hollow interior 39, and the first lateral attachment member 30 of each blade housing 4 are preferably, but not necessarily releasable attached to a corresponding second lateral attachment member 31 provided laterally at the central portion 29 of the rotary casing 1 by means of fastening means extending from the hollow interior 39 of the rotary casing 1 into the first lateral attachment member 30 of each blade housing 4 as illustrated in FIGS. 20 and 21. Such fastening allows for easy of attachment of the blade housings 4 to and detaching of the blade housings 4 from the central portion 29 of the rotary casing 1. It is for example possible that threaded holes 36 in the first lateral attachment member 30 of each blade housing 4 are aligned with holes 37 at said corresponding second lateral attachment member 31 provided laterally at the central portion 29 of the rotary casing 1, and that the fastening means comprises bolts 38 screwed into the threaded holes 36 in the first lateral attachment member 30 of each blade housing 4 from the hollow interior 39 of the rotary casing 1 so that the heads of each bolt 38 are at least partly inside the hollow interior 39 of the rotary casing 1.

Figure 7:
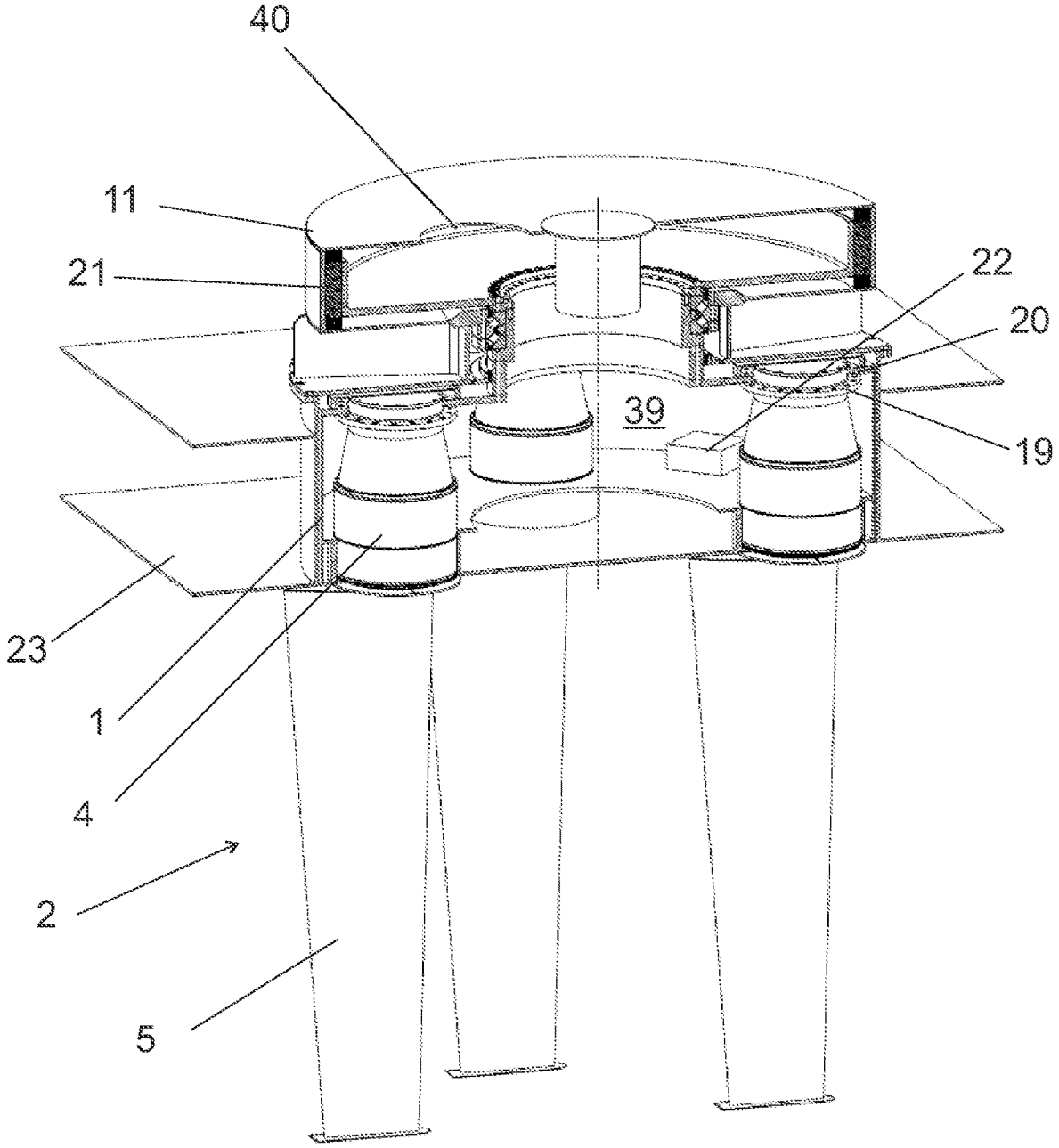
FIG. 7 shows another embodiment of the marine propulsion unit in cut view.
Figure 8:
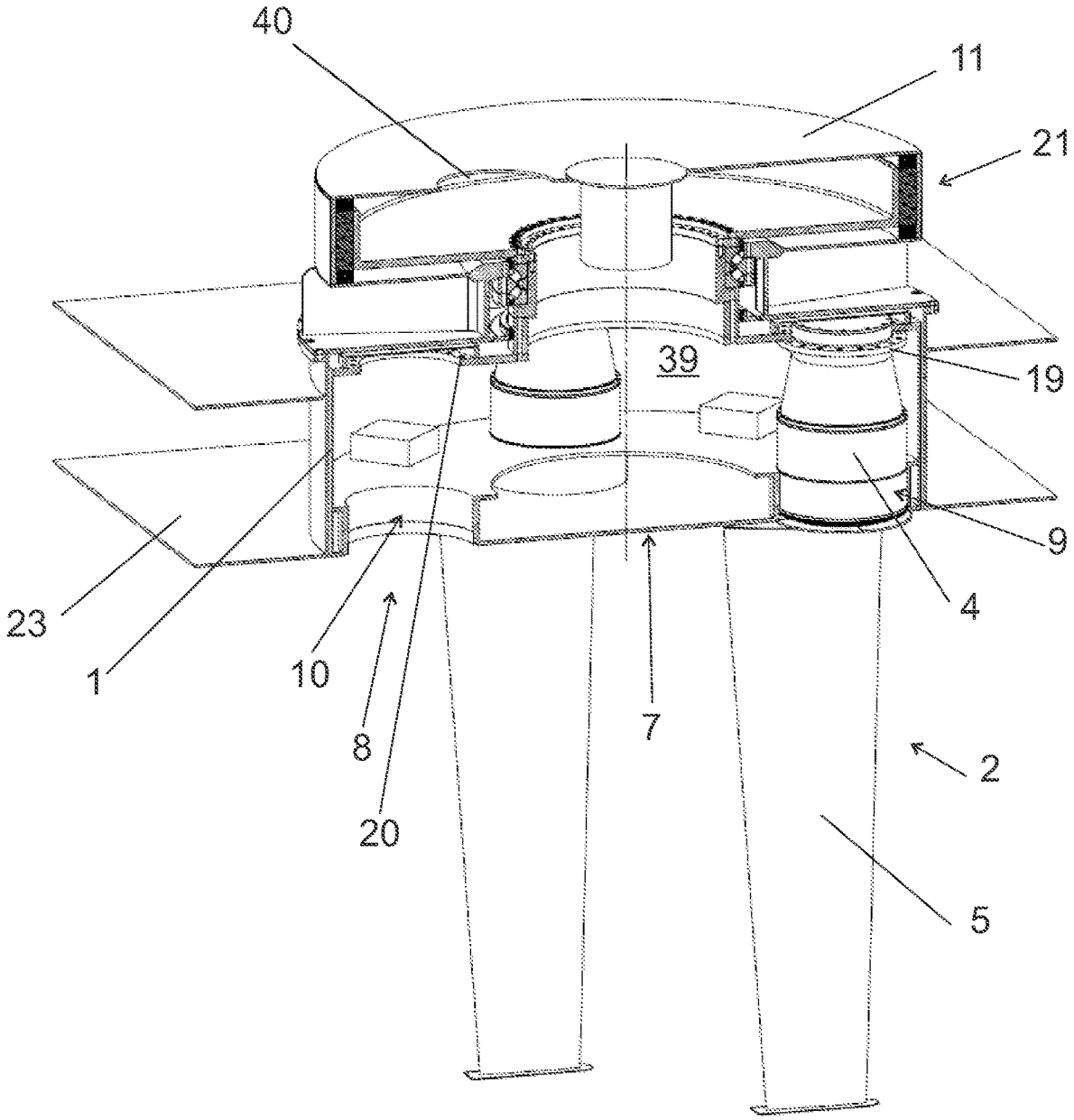
FIG. 8 shows the marine propulsion unit shown in FIG. 1 in cut view and in a state, where one blade unit is removed.
Figure 9:
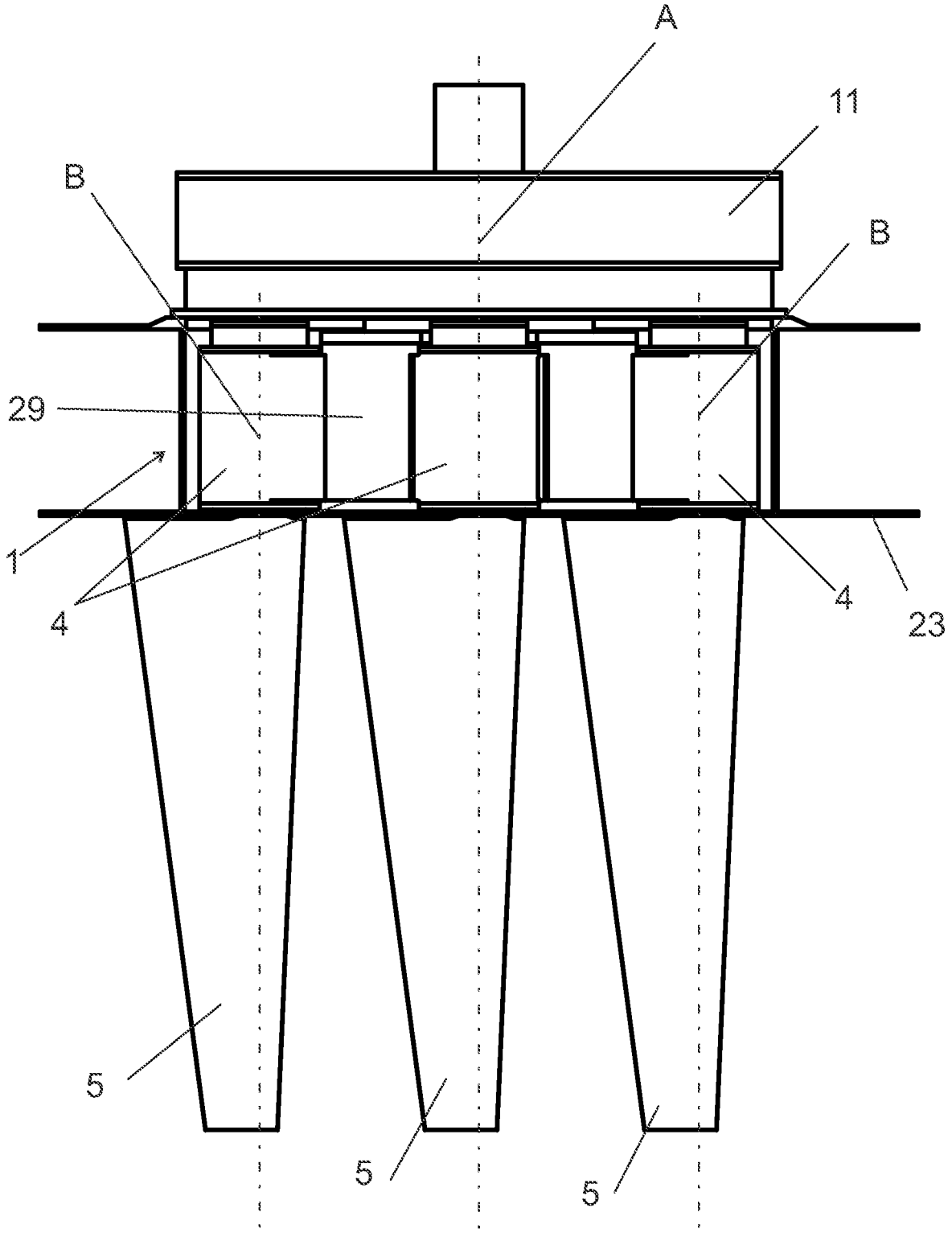
FIG. 9 shows in partly cut view a second embodiment of the marine propulsion unit.
Figure 10:
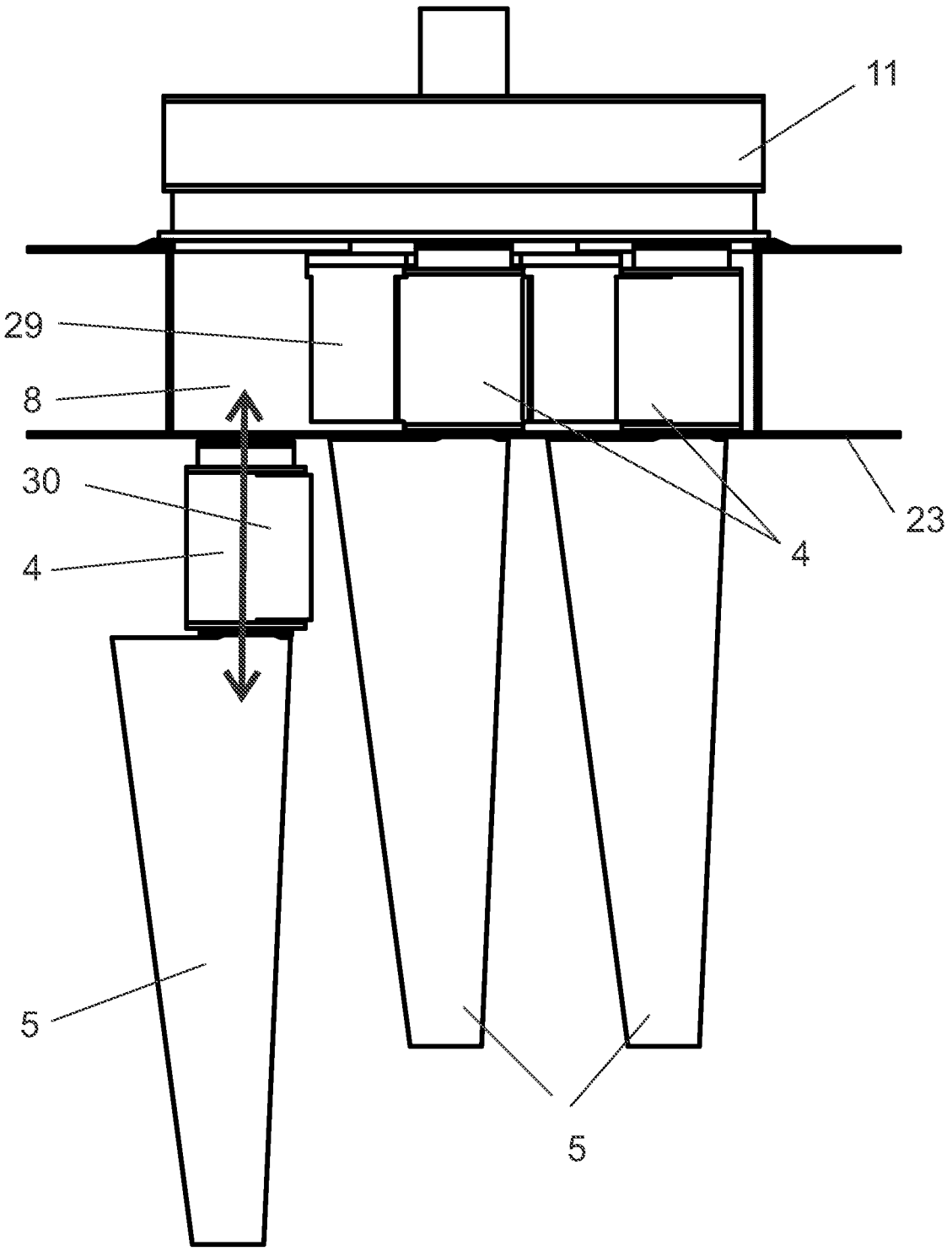
FIG. 10 shows in partly cut view the marine propulsion unit shown in FIG. 9 in a state, where one blade unit is either being removed from a seat extending from the lower surface of the rotary casing by moving the blade housing of the blade unit out of said seat from the side of the lower surface or the rotary casing or being mounted into seat extending from the lower surface of the rotary casing by moving the blade housing of the blade unit into said seat from the side of the lower surface or the rotary casing.
Figure 11:
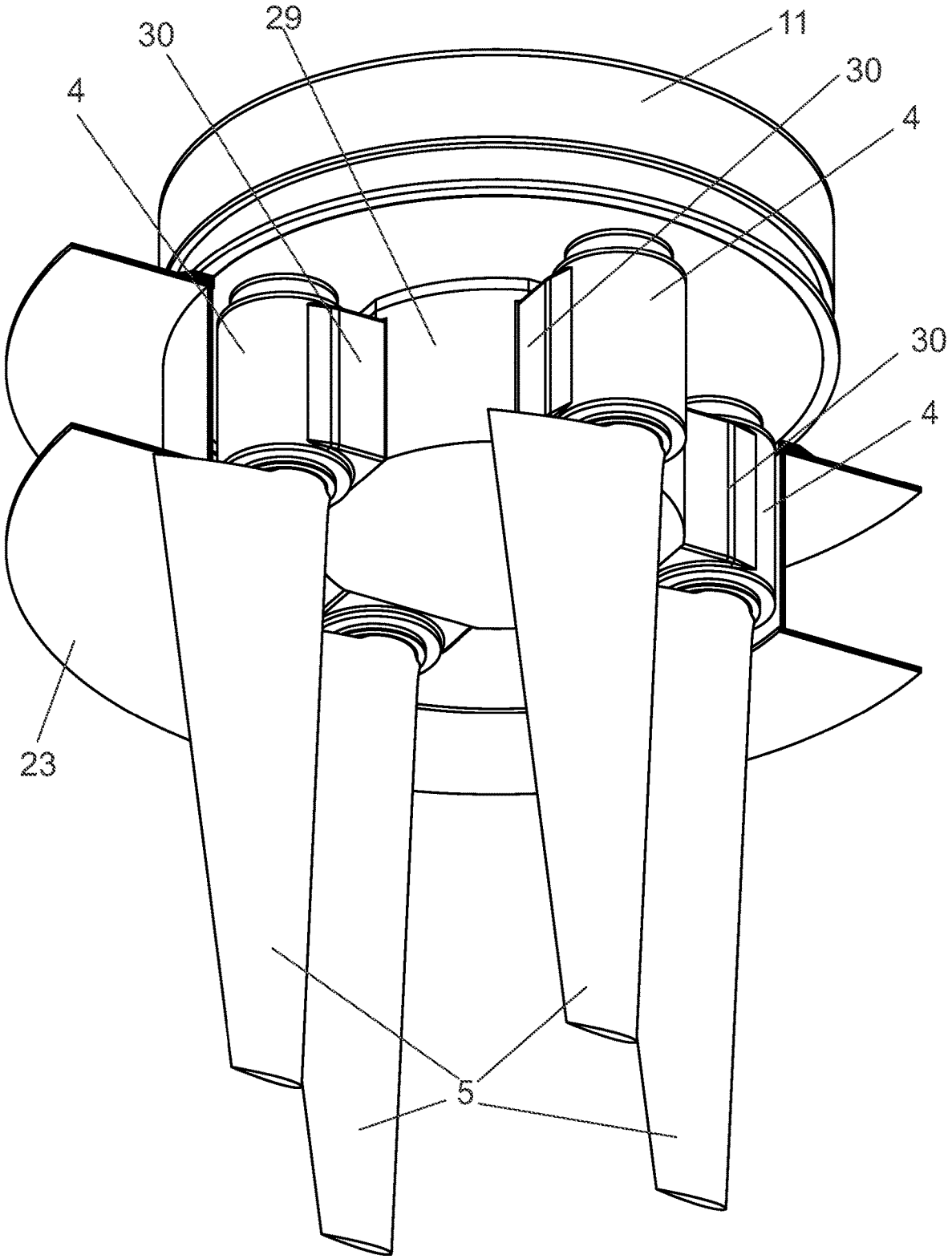
FIG. 11 shows in partly cut view the marine propulsion unit shown in FIG. 9.
Figure 12:
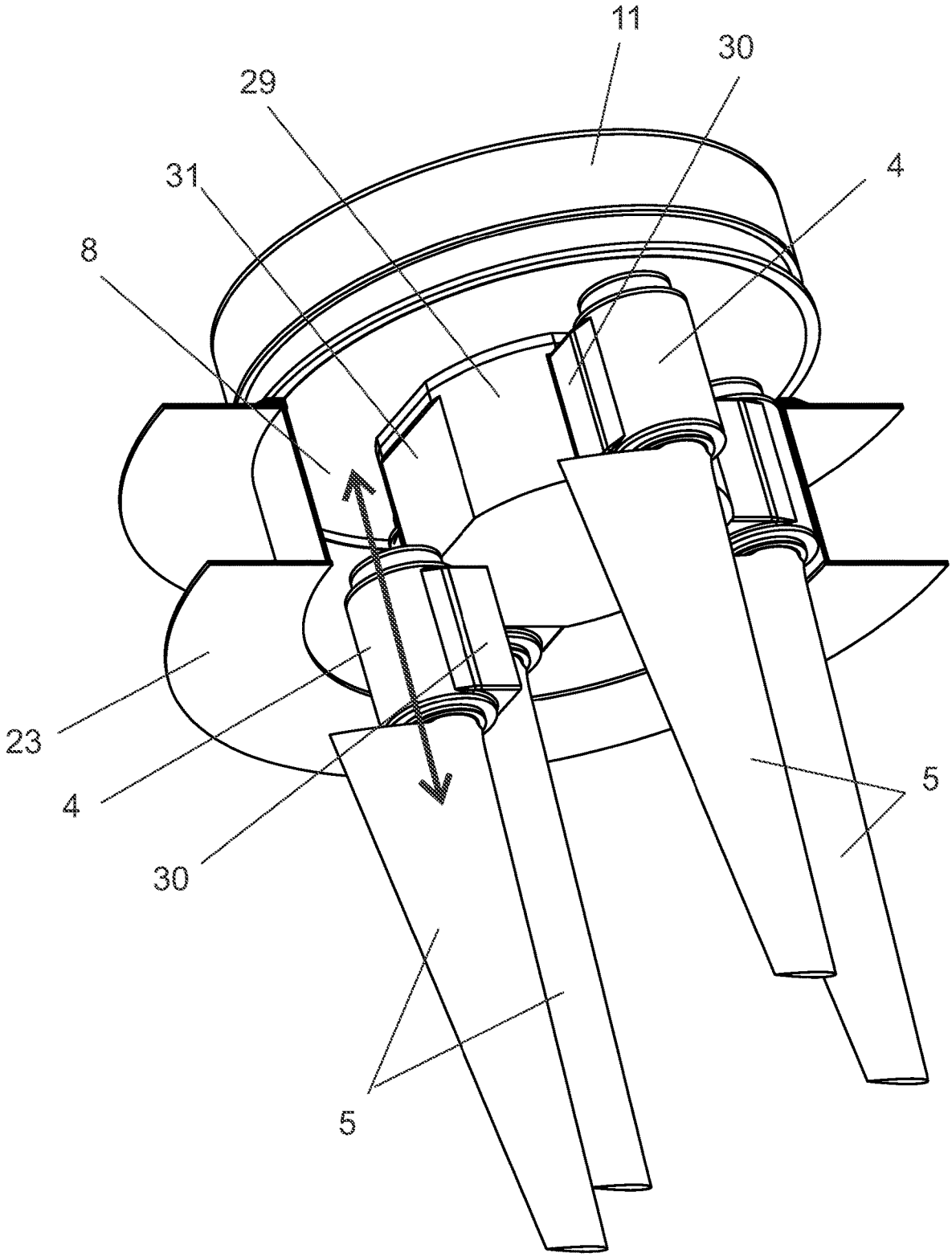
FIG. 12 shows in partly cut view the marine propulsion unit shown in FIG. 9 in a state, where one blade unit is either being removed from a seat extending from the lower surface of the rotary casing by moving the blade housing of the blade unit out of said seat from the side of the lower surface or the rotary casing or being mounted into seat extending from the lower surface of the rotary casing by moving the blade housing of the blade unit into said seat from the side of the lower surface or the rotary casing.
Figure 13:
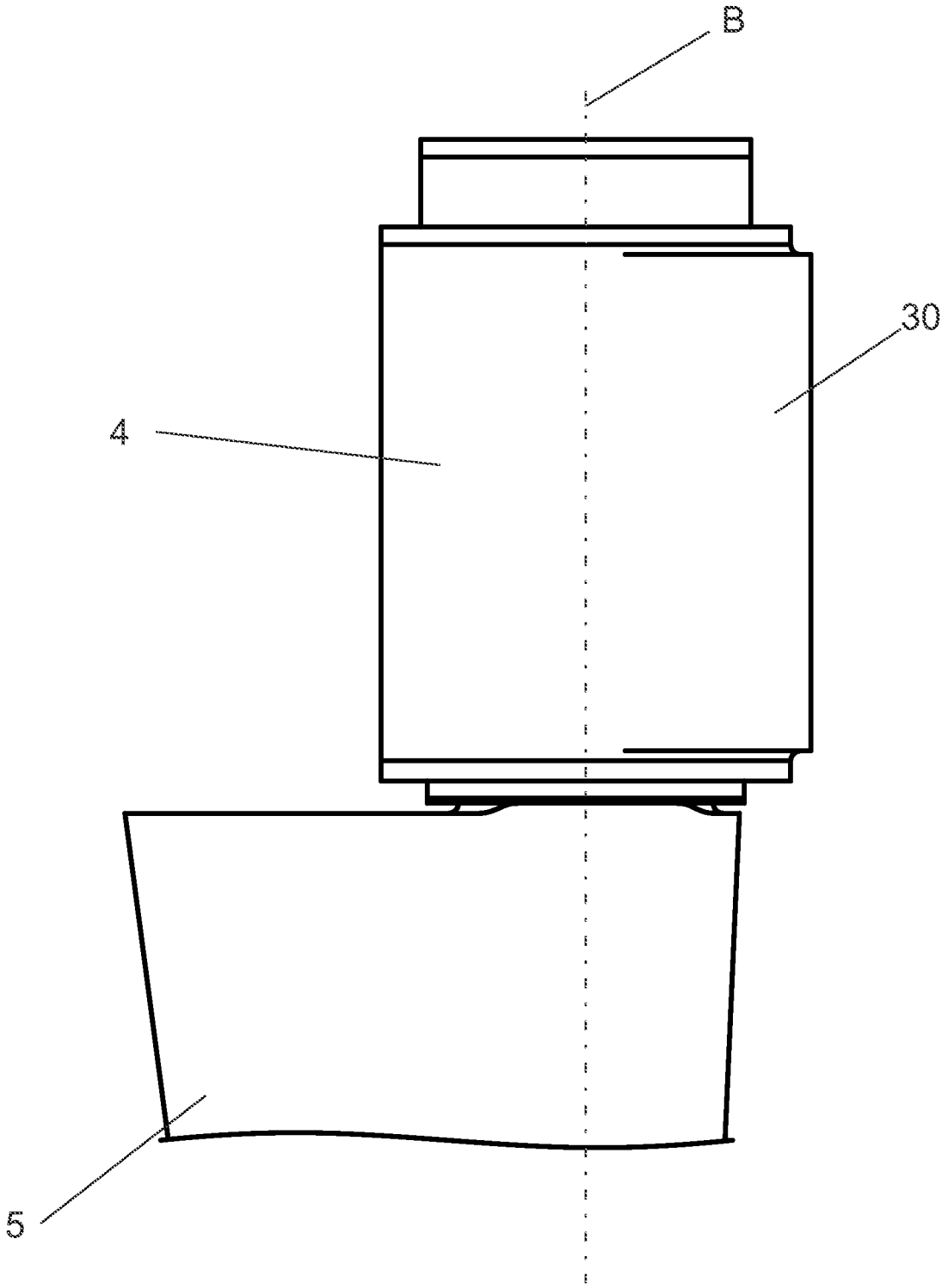
FIG. 13 shows a detail of a blade unit of the marine propulsion unit shown in FIG. 9.
Figure 14:
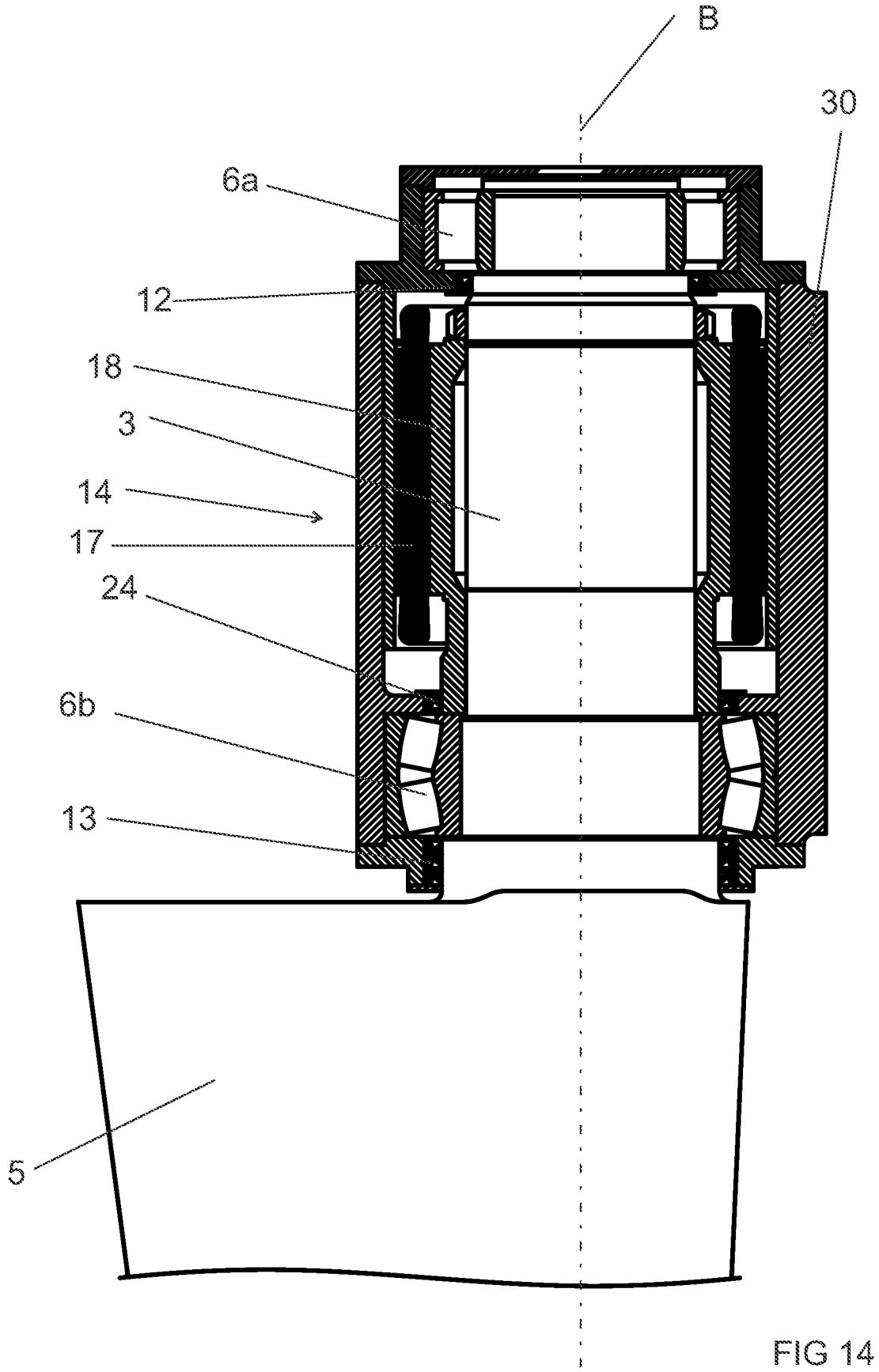
FIG. 14 shows in partly cut view a detail of a blade unit of the marine propulsion unit shown in FIG. 9.
Figure 15:
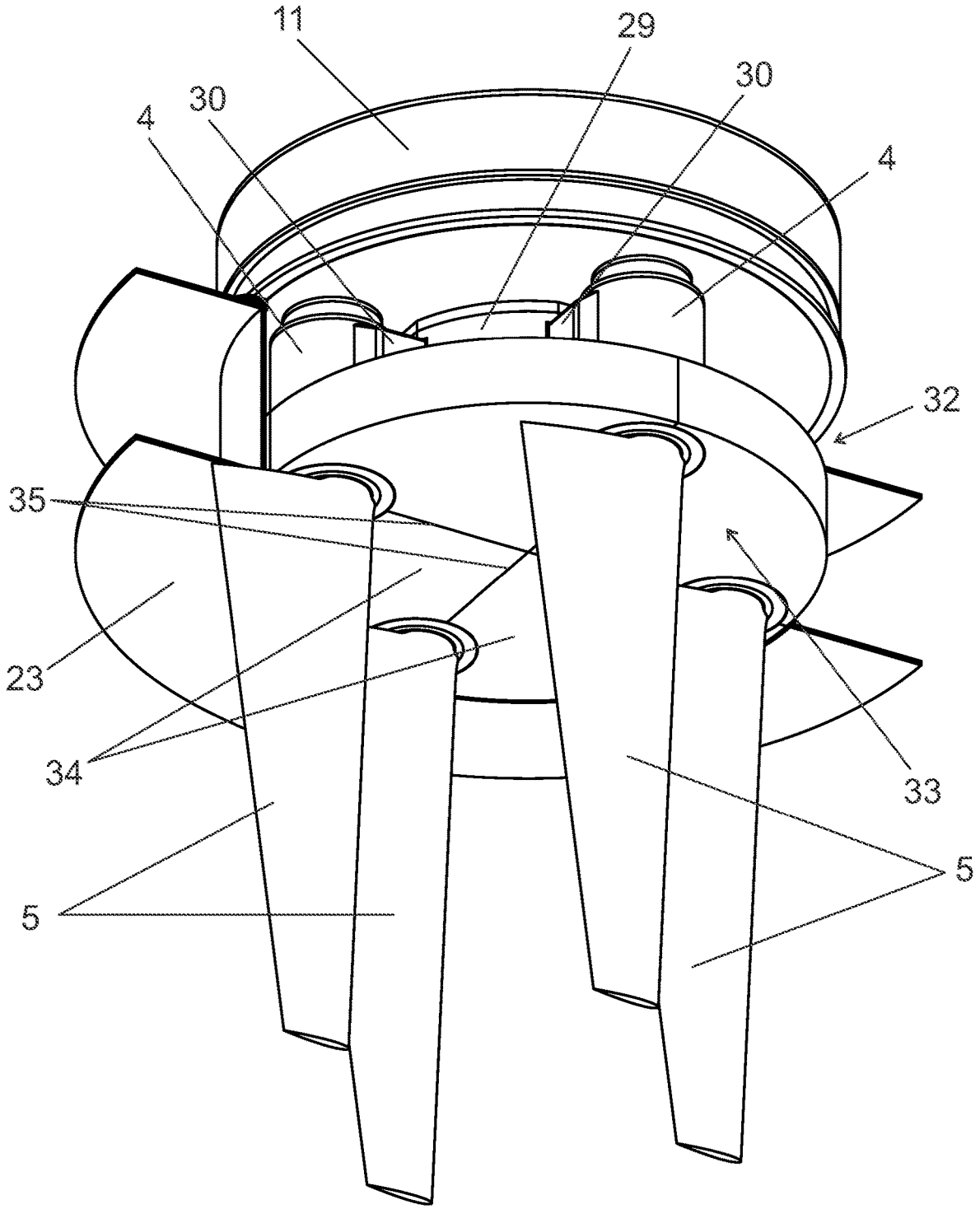
FIG. 15 shows in in partly cut view a third embodiment of the marine propulsion unit.
Figure 16:
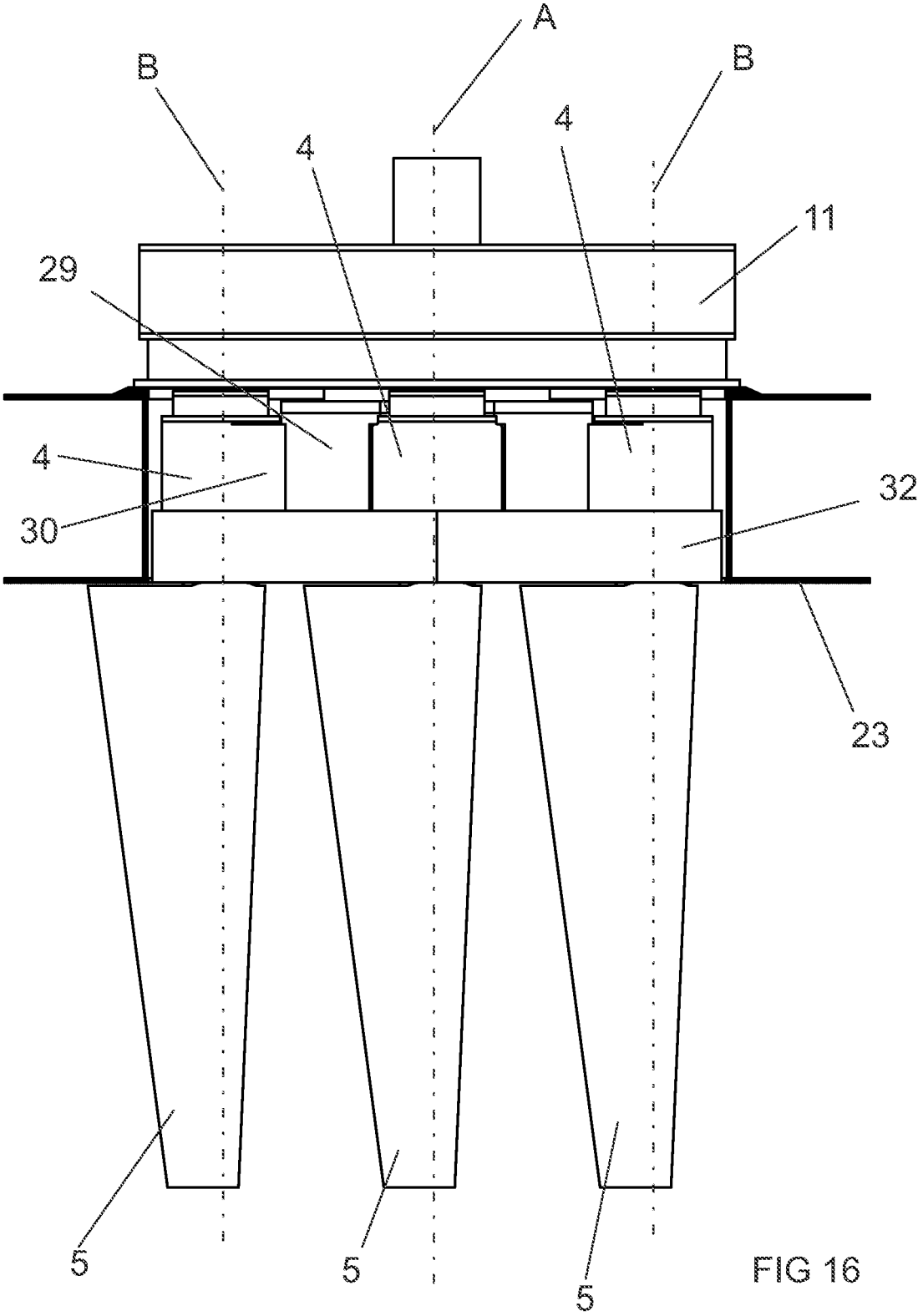
FIG. 16 shows the marine propulsion unit shown in FIG. 15 as seen from the side.
Figure 17:
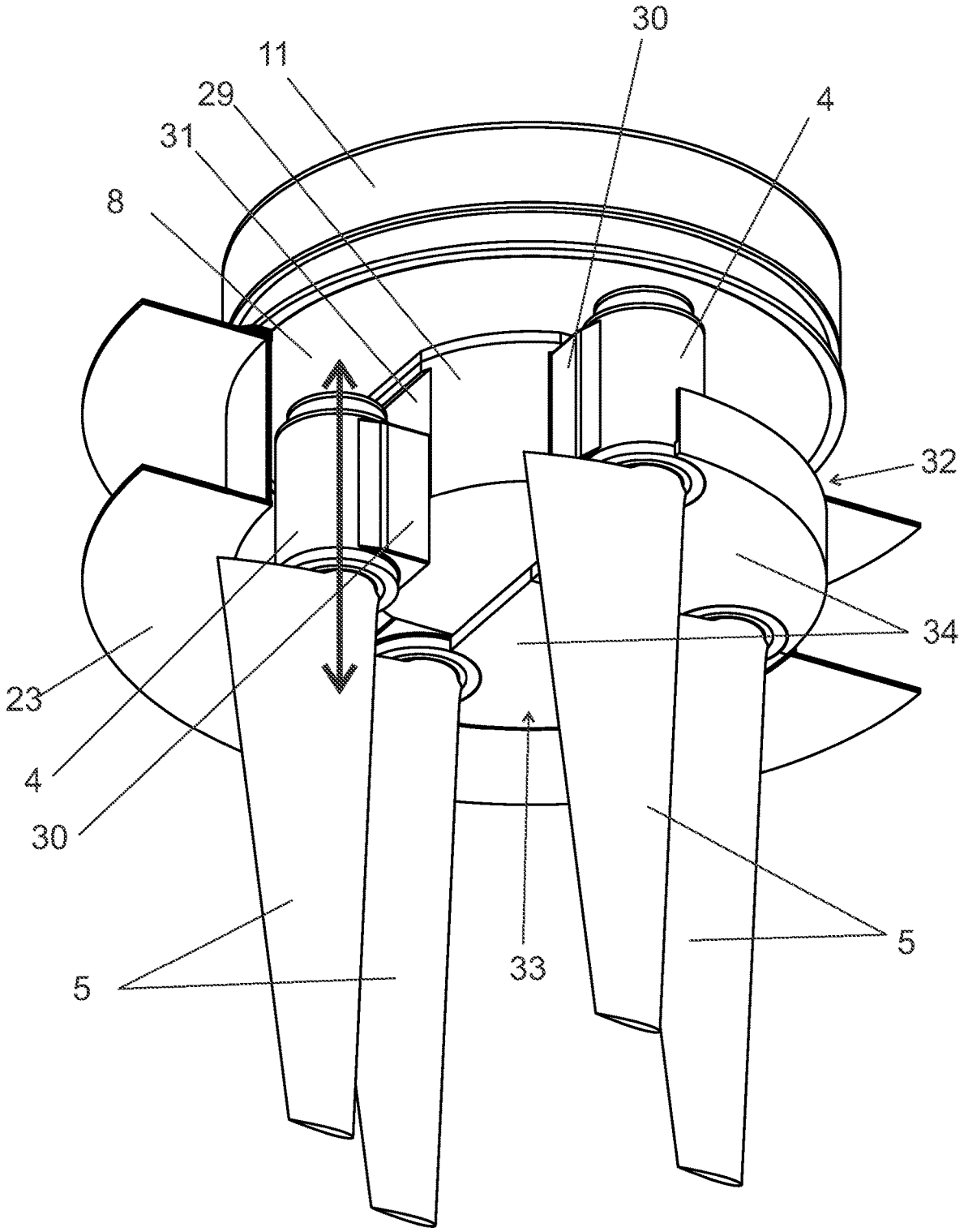
FIG. 17 shows in partly cut view the marine propulsion unit shown in FIG. 15 in a state, where outer casing sections of the outer casing of the rotary casing has been removed and where one blade unit is either being removed from the central portion of the rotary casing or being mounted to the central portion of the rotary casing.
Figure 18:
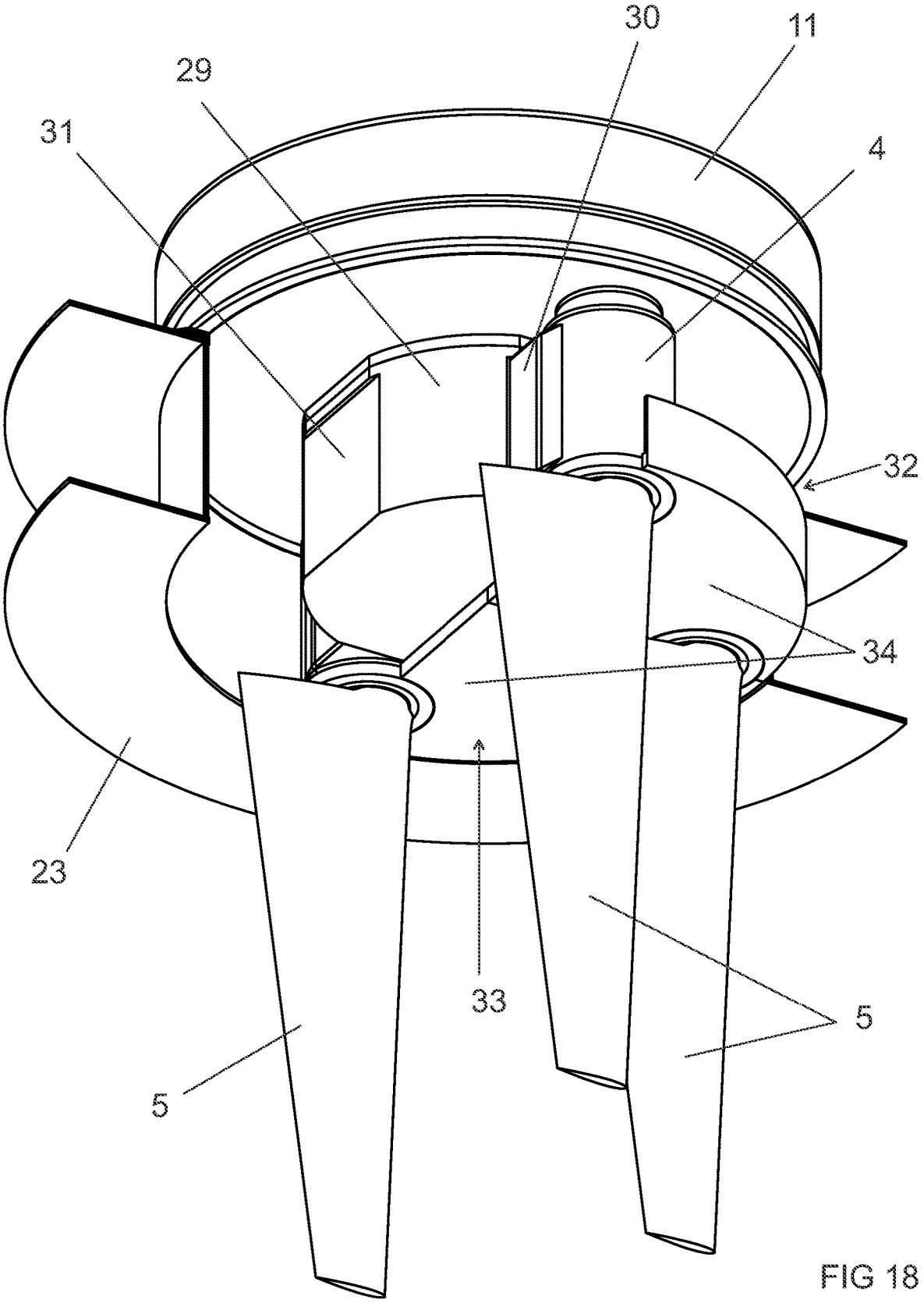
FIG. 18 shows in partly cut view the marine propulsion unit shown in FIG. 15 in a state, where outer casing sections of the outer casing of the rotary casing has been removed and where one blade unit has been being removed.

The marine propulsion unit comprises preferably, but not necessarily, a mounting body 11, configured to attach the marine propulsion unit to a marine vessel or the like such as to a ship, preferably to the hull 23 of a ship, wherein the rotary casing 1 is rotatable mounted at said mounting body 11 for said rotation about the central axis A. The marine propulsion unit comprises preferably, but not necessarily, a mounting body 11, configured to attach the marine propulsion unit to a marine vessel or the like such as to a ship, preferably to the hull 23 of a ship, wherein the rotary casing 1 is rotatable mounted at said mounting body 11 for said rotation about the central axis A, and the rotary casing 1 comprises preferably, but not necessarily, having a hollow interior 39, and the marine propulsion unit is preferably, but not necessarily, provided with a manhole arrangement 40 for providing access to the hollow interior 39 of the rotary casing 1 so that the manhole arrangement 40 leads through the mounting body 11 into the hollow interior 39 of the rotary casing 1, as illustrated in FIGS. 7, 8 and 20. The marine propulsion unit comprises preferably, but not necessarily, a rotating means 21 configured to rotate the rotary casing 1 with respect to the mounting body 11. The rotating means 21 can comprise one of an electric motor, as in the embodiment illustrated in FIGS. 7, 8, and 20 a hydraulic arrangement, and a mechanical arrangement or a combination thereof.

The bearings for supporting the blades in the blade housings 4 comprise preferably, but not necessarily, a first bearing 6*a* and a second bearing 6*b*. The first bearing 6*a* is provided inside the blade housing 4 at a first end (not marked with a reference numeral) of the blade shaft portion 3 of the blade 2 and the second bearing 6*b* is provided inside the blade housing 4 at the opposite second end (not marked with a reference numeral) of the blade shaft portion 3 of the blade 2. An advantage of this is that the first bearing 6*a* and the second bearing 6*b* will as far from each other as possible and this provides for a stable supporting of the blades 2 in the blade housings 4.

If the bearings for supporting the blades in the blade housings 4 comprise a first bearing 6*a* and a second bearing 6*b* as described, the first bearing 6*a* is preferably, but not necessarily, a cylindrical bearing or a roller bearing. One purpose of the first bearing 6*a* is to transmit radial forces from the blade 2 to the rotary casing 1 via the blade housing 4.

If the bearings for supporting the blades in the blade housings 4 comprise a first bearing 6*a* and a second bearing 6*b* as described, a first seal arrangement 12 is preferably, but not necessarily, provided between the blade shaft portion 3 of the blade 2 and the blade housing 4 at the first bearing 6*a* on the side of the first bearing 6*a* that faces the second bearing 6*b*. One purpose of the first seal arrangement 12 is to prevent lubrication from leaking from the first bearing 6*a*.

If the bearings for supporting the blades in the blade housings 4 comprise a first bearing 6*a* and a second bearing 6*b* as described, the second bearing 6*b* is preferably, but not necessarily, a spherical roller bearing. The spherical roller bearing transmits axial and radial forces from the blade 2 to the rotary casing 1 via the blade housing 4.

If the bearings for supporting the blades 2 in the blade housings 4 comprise a first bearing 6*a* and a second bearing 6*b* as described, a second seal arrangement 13 is preferably, but not necessarily, between the blade shaft portion 3 of the blade 2 and the blade housing 4 at the second bearing 6*b* on the side of the second bearing 6*b* that faces the blade portion 5 of the blade 2. One purpose of the second seal arrangement 13 is to protect the second bearing against water that at least partly surrounds the blade portion 5 of the blade 2, when the marine propulsion unit is mounted at a marine vessel and when the marine vessel floats in water. Another purpose of the second seal arrangement 13 is to prevent lubrication from leaking from the second bearing 6*a*.

If the bearings for supporting the blades in the blade housings 4 comprise a first bearing 6*a* and a second bearing 6*b* as described, a third seal arrangement 24 is preferably, but not necessarily, between the blade shaft portion 3 of the blade 2 and the blade housing 4 at the second bearing 6*b* on the side of the second bearing 6*b* that faces the first bearing 6*a*. One purpose of the third seal arrangement 24 is to prevent lubrication from leaking from the second bearing 6*a*.

Each blade comprises preferably, but not necessarily, a pivoting means 14 functionally connected between the blade 2 and the blade housing 4. The pivoting means 14 is configured to pivot the blade 2 with respect to the blade housing 4 for performing said pivotal movement of the blade 2 about blade axes B, which may be generally parallel to the central axis A. Each pivoting means 14 can comprise one of an electric motor, a hydraulic arrangement, and a mechanical arrangement or a combination thereof. Each pivoting means 14 is preferably, but not necessarily, independently operable. The blade portion 5 of each blade 2 comprises preferably, but not necessarily, an elongated leading edge 15 and an elongated trailing edge 16, and by the marine propulsion unit comprises preferably, but not necessarily, a steering unit 22 configurable to control the pivoting means 14 so that the trailing edge 16 of the blade portion 5 of each blade 2 moves in an ordinary cycloid or curtate cycloid path when the marine propulsion unit moves linearly when propulsing a marine vessel to move the marine vessel linearly or along a curve when propulsing a marine vessel to move the marine vessel along a curve.

If each blade 2 comprises a pivoting means 14, as described, the blade housing 4 encapsulates preferably, but not necessarily, the pivoting means 14. An advantage of this is that the blade housing 4 protects the pivoting means 14 during assembly at the rotary casing 1. Another advantage is that the pivoting means 14 can be sealed in the blade housing 4 against water by means of the blade housing 4. Another advantage of this is that this provides for an assembly-ready unit comprising both the blade 2 and the pivoting means 14 for pivoting the blade 2 with respect to the rotary casing 1.

If each blade 2 of the marine propulsion unit comprise a first bearing 6*a* and a second bearing 6*b* as described, and if each blade of the marine propulsion unit comprise a pivoting means 14, as described, the pivoting means 14 is preferably, but not necessarily, functionally connected to the blade shaft portion 3 of the blade 2 between the first bearing 6*a* and the second bearing 6*b*, as shown in FIG. 6. In such case, each pivoting means 14 is preferably, but not necessarily, an electric motor (not marked with a reference numeral), wherein the electric motor surrounds the blade shaft portion 3 of the blade 2 in the blade housing 4. If each pivoting means 14 is an electric motor, the stator 17 of the electric motor is preferably, but not necessarily, attached to the blade housing 4, and the rotor 18 of the electric motor is preferably, but not necessarily, attached to the blade shaft portion 3 of the blade 2, as shown in FIG. 7.

Each blade housing 4 comprise preferably, but not necessarily, at least one bolt flange 19 at the blade housing 4, wherein the bolt flange 19 is configured to co-operate with fastening means 20, such as with a co-operating bolt flange, at the rotary casing 1 for releasable attaching the blade housing 4 to the rotary casing 1.

Each blade housing 4 can for example comprise, as shown in the figures, a bolt flange 19 at one end of the blade housing 4, wherein the bolt flange 19 is configured to co-operate with fastening means 20, such as with a co-operating bolt flange, at the rotary casing 1 for releasable attaching the blade housing 4 to the rotary casing 1.

The rotary casing 1 of the marine propulsion unit has preferably, but not necessarily, a hollow interior 39, and the marine propulsion unit is preferably, but not necessarily provided with a manhole arrangement 40 for providing access to the hollow 39 interior of the rotary casing 1 as illustrated in FIGS. 7, 8 and 20. Such manhole arrangement 40 is preferably, but not necessarily, configured to provide a passage between the hollow interior 39 of the rotary casing 1 and the marine vessel.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A marine propulsion unit comprising:

a rotary casing rotatable about a central axis A, and blades extending axially from the rotary casing for rotation with the rotary casing about the central axis A, wherein each blade is mounted for pivotal movement about blade axes B, characterized:

by a blade shaft portion of each blade is at least partly surrounded by a blade housing and by a blade portion of each blade is outside the blade housing, wherein the blade housing is releasably attached to the rotary casing, and by each blade being supported in the blade housing by means of bearings for said pivotal movement, by the rotary casing comprising a lower surface that is configured to be in direct contact with water, by mounting seats being designed and dimensioned to allow inserting and removal of a blade housing having a blade supported in the blade housing by means of bearings solely from the side of lower surface of the rotary casing, by the rotary casing comprises a central portion, by each blade housing comprises a first lateral attachment member, by each blade housing being releasably attached to the rotary casing so that the first lateral attachment member of each blade housing being attached to a corresponding second lateral attachment member provided laterally at the central portion of the rotary casing.

2. The marine propulsion unit according to claim 1, characterized:

by the blade housing has an outer surface and the mounting seat has an inner surface, and by the outer surface of the blade housing abuts the inner surface of the mounting seat so as to prevent lateral movement of the blade housing in the mounting seat.

3. The marine propulsion unit according to claim 1, characterized:

by the blade housing has a first section where the cross-section form and the outer dimensions of the blade housing corresponds to the cross-section form and inner dimensions of a second section of the mounting seat so as to prevent lateral movement of the blade housing in the mounting seat.

4. The marine propulsion unit according to claim 1, characterized by the blade housing comprises a first lower flange having an upper surrounding surface configured to abut a lower surrounding surface of a second lower flange that surrounds the mounting seat when the blade housing is brought into a mounting position in the mounting seat from the side of the lower surface of the rotary casing.

5. The marine propulsion unit according to claim 1, characterized:

by the rotary casing comprises an outer casing surrounding the central portion of the rotary casing, by the outer casing comprises the mounting seats configured to releasably receive the blade housing of each blade, and by the mounting seats extend from a lower outer surface of the outer casing of the rotary casing.

6. The marine propulsion unit according to claim 5, characterized:

by the outer casing is composed of several outer casing sections separated by division planes dividing each mounting seat in the outer casing in at least two mounting seat sections so the that adjacent outer casing sections of the outer casing includes a mounting seat section of at least one mounting seat.

7. The marine propulsion unit according to claim 5, characterized:

by the mounting seats in the outer casing of the rotary casing being designed and dimensioned to allow inserting and removal of a blade housing having a blade supported in the blade housing by means of bearing solely from the side of lower outer surface of the outer casing of the rotary casing.

8. The marine propulsion unit according to claim 1, characterized:

by the rotary casing having a hollow interior, and by the first lateral attachment member of each blade housing being releasably attached to a corresponding second lateral attachment member provided laterally at the central portion of the rotary casing by means of fastening means extending from the hollow interior of the rotary casing into the first lateral attachment member of each blade housing.

9. The marine propulsion unit according to claim 8, characterized:

by threaded holes in the first lateral attachment member of each blade housing being aligned with holes at said corresponding second lateral attachment member provided laterally at the central portion of the rotary casing, and by the fastening means comprising bolts screwed into the threaded holes in the first lateral attachment member of each blade housing from the hollow interior of the rotary casing so that the heads of each bolt being inside the hollow interior of the rotary casing.

10. The marine propulsion unit according to claim 1, characterized:

by the marine propulsion unit comprising a mounting body, and by the rotary casing being rotatable mounted at said mounting body for said rotation about the central axis A.

11. The marine propulsion unit according to claim 1, characterized:

by the marine propulsion unit comprising a mounting body, by the rotary casing being rotatable mounted at said mounting body for said rotation about the central axis A, by the rotary casing having a hollow interior, by the marine propulsion unit being provided with a manhole arrangement for providing access to the hollow interior of the rotary casing, and by the manhole arrangement leading through the mounting body into the hollow interior of the rotary casing.

12. The marine propulsion unit according to claim 1, characterized:

by the bearings comprise a first bearing and a second bearing, and by the first bearing being provided inside the blade housing at a first end of the blade shaft portion of the blade and by the second bearing being provided inside the blade housing at the opposite second end of the blade shaft portion of the blade.

13. The marine propulsion unit according to claim 12, characterized:

by the first bearing is a cylindrical bearing or a roller bearing.

14. The marine propulsion unit according to claim 12, characterized:

by a first seal arrangement between the blade shaft portion of the blade and the blade housing at the side of the first bearing that faces the second bearing.

15. The marine propulsion unit according to claim 12, characterized:

by the second bearing is a spherical roller bearing.

16. The marine propulsion unit according to claim 12, characterized:

by a second seal arrangement between the blade shaft portion of the blade and the blade housing at the side of the second bearing that faces the blade portion of the blade.

17. The marine propulsion unit according to claim 12, characterized:

by a third seal arrangement between the blade shaft portion of the blade and the blade housing at the side of the second bearing that faces the first bearing.

18. The marine propulsion unit according to claim 12, characterized:

by each blade comprising a pivoting means functionally connected between the blade and the blade housing to pivot the blade with respect to the blade housing by means of the pivoting means for performing said pivotal movement of the blade about blade axes B.

19. The marine propulsion unit according to claim 18, characterized:

by each pivoting means comprising one of an electric motor, a hydraulic arrangement, and a mechanical arrangement or a combination thereof.

20. The marine propulsion unit according to claim 18, characterized:

by each pivoting means being independently operable.

21. The marine propulsion unit according to claim 18, characterized:

by the blade portion of each blade comprising an elongated leading edge and an elongated trailing edge, and by the marine propulsion unit comprising a steering unit configurable to control the pivoting means so that the trailing edge of the blade portion of each blade moves in an ordinary cycloid or curtate cycloid path when the marine propulsion unit moves.

22. The marine propulsion unit according to claim 18, characterized:

by the blade housing encapsulates the pivoting means.

23. The marine propulsion unit according to claim 18, characterized:

by the pivoting means being functionally connected to the blade shaft portion of the blade between the first bearing and the second bearing.

24. The marine propulsion unit according to claim 23, characterized:

by each pivoting means being an electric motor, and by the electric motor surrounds the blade shaft portion of the blade in the blade housing.

25. The marine propulsion unit according to claim 24, characterized:

by a stator of the electric motor is attached to the blade housing, and by a rotor of the electric motor is attached to the blade shaft portion of the blade.

26. The marine propulsion unit according to claim 1, characterized:

by the blade housing comprising a bolt flange at the blade housing, and by the bolt flange being configured to co-operate with fastening means at the rotary casing for releasably attaching the blade housing to the rotary casing.

27. The marine propulsion unit according claim 1, characterized:

by the rotary casing having a hollow interior, and by the marine propulsion unit being provided with a manhole arrangement for providing access to the hollow interior of the rotary casing.

28. A combination of a marine vessel and a marine propulsion unit according to claim 1, characterized:

by the rotary casing having a hollow interior and by the rotary casing being provided with a manhole arrangement for providing a passage between the hollow interior of the rotary casing and the marine vessel.

29. A marine propulsion unit comprising:

a rotary casing rotatable about a central axis A, and blades extending axially from the rotary casing for rotation with the rotary casing about the central axis A, wherein each blade is mounted for pivotal movement about blade axes B, characterized:

by a blade shaft portion of each blade is at least partly surrounded by a blade housing and by a blade portion of each blade is outside the blade housing, wherein the blade housing is releasably attached to the rotary casing, and by each blade being supported in the blade housing by means of bearings for said pivotal movement, by the rotary casing comprising a lower surface that is configured to be in direct contact with water, by mounting seats being designed and dimensioned to allow inserting and removal of a blade housing having a blade supported in the blade housing by means of bearings solely from the side of lower surface of the rotary casing, by the marine propulsion unit comprising a mounting body, by the rotary casing being rotatable mounted at said mounting body for said rotation about the central axis A, by the rotary casing having a hollow interior, by the marine propulsion unit being provided with a manhole arrangement for providing access to the hollow interior of the rotary casing, and by the manhole arrangement leading through the mounting body into the hollow interior of the rotary casing.

30. A marine propulsion unit comprising:

a rotary casing rotatable about a central axis A, and blades extending axially from the rotary casing for rotation with the rotary casing about the central axis A, wherein each blade is mounted for pivotal movement about blade axes B, characterized:

by a blade shaft portion of each blade is at least partly surrounded by a blade housing and by a blade portion of each blade is outside the blade housing, wherein the blade housing is releasably attached to the rotary casing, and by each blade being supported in the blade housing by means of bearings for said pivotal movement, by the rotary casing comprising a lower surface that is configured to be in direct contact with water, by mounting seats being designed and dimensioned to allow inserting and removal of a blade housing having a blade supported in the blade housing by means of bearings solely from the side of lower surface of the rotary casing, by the blade housing comprising a bolt flange at the blade housing, and by the bolt flange being configured to co-operate with fastening means at the rotary casing for releasably attaching the blade housing to the rotary casing.

31. A marine propulsion unit comprising:

a rotary casing rotatable about a central axis A, and blades extending axially from the rotary casing for rotation with the rotary casing about the central axis A, wherein each blade is mounted for pivotal movement about blade axes B, characterized:

by a blade shaft portion of each blade is at least partly surrounded by a blade housing and by a blade portion of each blade is outside the blade housing, wherein the blade housing is releasably attached to the rotary casing, and by each blade being supported in the blade housing by means of bearings for said pivotal movement, by the rotary casing comprising a lower surface that is configured to be in direct contact with water, by mounting seats being designed and dimensioned to allow inserting and removal of a blade housing having a blade supported in the blade housing by means of bearings solely from the side of lower surface of the rotary casing, by the rotary casing having a hollow interior, and by the marine propulsion unit being provided with a manhole arrangement for providing access to the hollow interior of the rotary casing.

32. A combination of a marine vessel and a marine propulsion unit, wherein the marine propulsion unit comprises:

a rotary casing rotatable about a central axis A, and blades extending axially from the rotary casing for rotation with the rotary casing about the central axis A, wherein each blade is mounted for pivotal movement about blade axes B, characterized:

by a blade shaft portion of each blade is at least partly surrounded by a blade housing and by a blade portion of each blade is outside the blade housing, wherein the blade housing is releasably attached to the rotary casing, and by each blade being supported in the blade housing by means of bearings for said pivotal movement, by the rotary casing comprising a lower surface that is configured to be in direct contact with water, by mounting seats being designed and dimensioned to allow inserting and removal of a blade housing having a blade supported in the blade housing by means of bearings solely from the side of lower surface of the rotary casing, and by the rotary casing having a hollow interior and by the rotary casing being provided with a manhole arrangement for providing a passage between the hollow interior of the rotary casing and the marine vessel.

33. A marine propulsion unit comprising:

a rotary casing rotatable about a central axis A, and blades extending axially from the rotary casing for rotation with the rotary casing about the central axis A, wherein each blade is mounted for pivotal movement about blade axes B, characterized:

by a blade shaft portion of each blade is at least partly surrounded by a blade housing and by a blade portion of each blade is outside the blade housing, wherein the blade housing is releasably attached to the rotary casing, and by each blade being supported in the blade housing by means of bearings for said pivotal movement, by the rotary casing comprises a central portion, by each blade housing comprises a first lateral attachment member, and by each blade housing being releasably attached to the rotary casing so that the first lateral attachment member of each blade housing being attached to a corresponding second lateral attachment member provided laterally at the central portion of the rotary casing.

* * * * *